US005464056A

United States Patent [19]

Tajima et al.

[11] Patent Number: 5,464,056

[45] Date of Patent: Nov. 7, 1995

[54] HOUSINGLESS TYPE OIL COOLER AND METHOD FOR PRODUCING THE SAME

[75] Inventors: Makoto Tajima; Shinji Araki; Kei Beppu, all of Tokyo, Japan

[73] Assignee: Calsonic Corporation, Tokyo, Japan

[21] Appl. No.: 170,803

[22] Filed: Dec. 21, 1993

[30] Foreign Application Priority Data

Dec. 21, 1992 [JP] Japan ..... 4-340674
Mar. 15, 1993 [JP] Japan ..... 5-054172

[51] Int. Cl.[6] ..... F28F 3/08

[52] U.S. Cl. ..... 165/167; 165/916; 123/196 AB

[58] Field of Search ..... 165/167, 916; 123/196 AB; 184/6.22, 104.3

[56] References Cited

U.S. PATENT DOCUMENTS 4,892,136 1/1990 Ichihara et al. ..... 165/167
5,099,912 3/1992 Tajima et al. ..... 165/133
5,236,043 8/1993 Armbruster et al. ..... 165/167

FOREIGN PATENT DOCUMENTS 112474 7/1987 Japan .
121272 8/1988 Japan .
121271 8/1988 Japan .
118116 8/1989 Japan .

*Primary Examiner*—Leonard R. Leo
*Attorney, Agent, or Firm*—Sughrue, Mion, Zinn, Macpeak & Seas

[57] ABSTRACT

The present invention relates to a housingless type oil cooler formed by laminating a plurality of plate members and an object thereof is to prevent deformation of an oil filter seal surface caused by excessive tightening at the time of mounting of an oil filter. An upper tank 111 opened in one side and shaped like a donut is mounted on an upper portion of a core portion 1 so as to cover the latter, a partition plate 113 is disposed in the inside of the upper tank 111, an oil-passing projection portion 115 having a second communicating hole 115A formed in its inner wall is formed on the partition plate 113 so that the inside of the oil-passing projection portion is communicated with an outlet 67B of an oil passage 67 and the second communicating hole 115A overlaps a first communicating hole 111A of the upper tank 111, a projection-like partition portion 117 is formed on the partition plate 113 so that the projection-like partition portion 117 is fixedly attached at its surface onto the inner wall surface of a top portion 111C of the upper tank 111 to thereby partition the inside of the upper tank 111 into an inlet tank chamber 125 and an outlet tank chamber 127, and a cooling water inflow pipe 131 and a cooling water outflow pipe 133 are connected to the upper tank 111.

2 Claims, 15 Drawing Sheets

HOUSINGLESS TYPE OIL COOLER AND METHOD FOR PRODUCING THE SAME

BACKGROUND OF THE INVENTION

The present invention relates to a housingless type oil cooler formed by laminating a plurality of plate members and a method for producing the same.

For example, an apparatus described in Japanese Utility Model Unexamined Publication No. Hei-4-87726 (U.S. Pat. No. 5,099,912) is known as a housingless type oil cooler formed by laminating a plurality of plate members.

FIGS. 18 through 20 show an example of such a type of housingless type oil cooler.

In the drawings, the reference numeral 1 designates a core portion formed by alternately laminating first and second plates 3 and 5 made of aluminum. A composite tank 4 is mounted on the core portion 1. In the composite tank 4, a cooling water inlet tank 11 and a cooling water outlet tank 13 are formed by an upper casing 7 and a lower casing 9 made of aluminum. Two cooling water passage holes 15 provided in the first plate 3 are opened in the inlet tank 11 and the outlet tank 13 respectively.

Further, as shown in FIG. 20, through-holes 17 and 19 are formed in the respective center portions of the upper casing 7 and the lower casing 9 while a through-hole 22 communicated with one of two oil passage holes 21 provided in the first plate 3 is formed in the lower casing 9 so that the other oil passage hole 21 of the first plate 3 is blocked by the lower casing 9. Further, a cooling water inflow pipe 23 and a cooling water outflow pipe 25 are attached to the upper casing 7 so as to be disposed concentrically at a distance of 180°. Respective insertion-side end portions 23*a* and 25*a* of the cooling water inflow and outflow pipes 23 and 25 are opened into the inlet and outlet tanks 11 and 13 respectively.

On the other hand, in a lower portion of the core portion 1, a lower plate 27, a reinforcement plate 29 and a mount plate 31 made of aluminum are disposed in order. Through-holes 33, 35 and 37 are formed in the center portions of the respective plates 27, 29 and 31 so as to be concentrical with the through-holes 17 and 19.

Further, in the side of these through-holes 33, 35 and 37, an oil inflow port 39 is formed so as to be opened into one of two oil passage holes 21 provided in the second plate 5. The other oil passage hole 21 of the second plate 5 is blocked by the lower plate 27. Further, second plate 5 side cooling passage holes 15, 15 are blocked by the lower plate 27. Further, a packing 41 is attached to a lower portion of the mount plate 31.

Further, through-holes 43 and 45 are formed in the center portions of the first and second plates 3 and 5 constituting the core portion 1. An oil outflow pipe 47 made of aluminum is attached in the two through-holes 43 and 45. Further, an oil return pipe (not shown) constituted by a stud bolt and fixed to a bracket (not shown) of an engine to form an oil outflow passage is inserted into the oil outflow pipe 47. The core portion 1 is fixed to the bracket by screwing a nut (not shown) with a screw portion (not shown) formed in an upper portion of the oil return pipe. Of course, a stud bolt formed by uniting the oil return pipe and the nut into one body can be screwed with the bracket.

Four through-holes are formed in the first and second plates 3 and 5 so as to be disposed at intervals of 90° from their center portions. A pair of through-holes opposite to each other are provided as a cooling water passage hole 15 described above whereas the other pair of through-holes opposite to each other are provided as an oil passage hole 21 described above.

As shown in FIG. 20, cylindrical portions 57 and 59 are integrally formed in the outer circumferential edge of a plate body 3*a* of the first plate 3 and the through-hole edge thereof. Further, projection portions 61 and 63 projecting toward the plate body 3*a* of the first plate 3 are integrally formed in the outer circumferential edge of a plate body 5*a* of the second plate 5 and the through-hole edge thereof. As shown in FIGS. 19 and 20, the outer sides of the projection portions 61 and 63 of the second plate 5 are brazed to the inner sides of the cylindrical portions 57 and 59 of the first plate 3 so that a cooling water passage 65 is formed by the inner side of the first plate 3 and the inner side of the second plate 5 and an oil passage 67 is formed by the outer side of the first plate 3 and the inner sides of the cylindrical portions 57 and 59 of the first plate 3.

As shown in FIG. 20, in the cylindrical portion 57 of 5 the first plate 3, a large-size portion 69 and a small-size portion 71 are formed in the opening end side and the plate body 3*a* side respectively. Brazing is performed in the condition in which the large portion 69 of an upper first plate 3 is fitted in the small-size portion 71 of a lower first plate 3 adjacent to the upper first plate 3 so that a second plate 5 is disposed between the first plates 3.

In the aforementioned housingless type oil cooler, after non-corrosive flux is applied onto respective parts and dried in advance, the projection portions 61 and 63 of the second plate 5 are fitted to the cylindrical portions 57 and 59 of the first plate 3. Then, the large-size portion 69 of the first plate 3 is fitted to the small-size portion 71 of the other first plate 3 and the oil outflow pipe 47 is inserted in the through-holes 43 and 45 disposed at the center portions of these plates 3 and 5 to thus form a core portion 1. Thereafter, the lower plate 27, the reinforcement plate 29 and the mount plate 31 are attached to the upper and lower casings 7 and 9 and heated in a furnace to perform brazing of the respective parts. Thus, the housingless type oil cooler is produced.

In the aforementioned housingless type oil cooler, after cooling water from the cooling water inflow pipe 23 flows into the cooling water inlet tank 11, the cooling water passes through the cooling water passage holes 15 of the first and second plates 3 and 5 so that respective cooling water passages 65 are filled with cooling water. Then, the cooling water is subjected to heat exchange with the oil in the oil passage 67 and then flows out from the outlet tank 13 side cooling water outflow pipe 25.

On the other hand, oil from the engine side oil inlet passage (not shown) flows into the core portion 1 through an oil inflow port 39 disposed in a lower portion of the core portion 1. After the oil passes through respective oil passage holes 21 so that the oil passage is filled with the oil, the oil is subjected to heat exchange with the cooling water in the cooling water passage 65 and then flows into an oil outlet tank (not shown). Thereafter, the oil is cleaned by an oil filter disposed above the oil outlet tank and then flows out from the oil outlet passage (not shown) to the engine side through an oil return pipe.

The conventional housingless type oil cooler, however, has a structure in which oil and cooling water are made to go in and out separately in an upper portion of the core portion 1, so that oil inlet and outlet passages and cooling water inlet and outlet passages occupy space in the upper portion the core portion 1. Therefore, the oil outlet tank is formed by the upper and lower casings 7 and 9. To make the oil outlet tank communicate with the oil filter disposed on the upper casing 7, an opening hole is formed in the center portion of the upper casing 7. Accordingly, the upper casing 7 having the opening hole in its center is shaped like a cantilever which is left flexible freely at its center but supported by its periphery. In the housingless type oil cooler having such structure, when the oil filter is tightened strongly, the center of an oil filter seal surface 81 which is an upper surface of the oil filter is deformed so as to be bent like a cantilever. As a result, sealing between the oil filter and the oil filter seal surface 81 of the upper casing 7 of the housingless oil cooler cannot be secured so that there is a risk of occurrence of oil leaking.

Further, the upper casing 7 and the lower casing 9 are integrated with each other by brazing the respective bent cylindrical portions in the condition in which the respective bent cylindrical portions are disposed so as to be opposite to each other. However, because respective single articles of the upper and lower casings 7 and 9 are processed by press forming, spring-back occurs so that the forward end of each bent cylindrical portion is widened. It is therefore difficult to join the joint surfaces of the bent cylindrical portions, so that to secure brazing quality is made difficult. In addition, there is a requirement on design to secure the height size for attaching the cooling water inflow pipe 23 and the cooling water outflow pipe 25 to the lower casing 9. However, as described above, because the upper casing 7 and the lower casing 7 are assembled while the respective bent cylindrical portions are disposed so as to be opposite to each other and because the bending of the upper casing 7 is larger, poor accuracy in single articles at the time of press forming cannot be absorbed so that the height size of the upper casing 7 is increased. As a result, the size of the housingless type oil cooler cannot be reduced to compact size.

Further, the outer circumferential surface of the bent cylindrical portion of the lower casing 9 and the inner circumferential surface of the bent cylindrical portion of the upper casing 7 are joined by brazing. However, because the upper casing 7 and the lower casing 9 are processed by press forming, it is difficult to process the respective cylindrical portions thereof in the form of a true circle in section. As a result, a gap is produced between the joint surfaces so that there is a risk of occurrence of mixing of oil and cooling water caused by poor brazing.

As described above, because the outer circumferential surface of the bent cylindrical portion of the lower casing 9 and the inner circumferential surface of the bent cylindrical portion of the upper casing 7 are joined by brazing, the inner circumferential surfaces of the inlet and outlet tanks 11 and 13 of the casing 9 in which cooling water flows are provided as a brazing material layer. As a result, there is a problem in poor corrosion-resisting property.

SUMMARY OF THE INVENTION

The present invention has been made to solve the aforementioned problems and an object thereof is to provide an oil cooler in which deformation of the oil filter seal surface caused by excessive tightening at the time of attachment of the oil filter can be prevented.

According to a first aspect of the invention, a housingless type oil cooler comprising: a core portion constituted by a plurality of plates respectively having through-holes formed at their center portions, the plates being alternately laminated on one another so that cooling water passages and oil passages are alternately formed between the plates; and one of an oil filter and a sealed flange being mounted on the core portion; is characterized in that: an upper tank opened at its one side, shaped a donut and having a first communicating hole in its inner wall is mounted on an upper portion of the core portion; a partition plate is disposed in the inside of the upper tank; a through-hole, an inlet hole and an outlet hole are formed in a flat portion of the partition plate so that the inlet hole and the outlet hole overlap an inlet and an outlet of the cooling water passages respectively, and an oil-passing projection portion and a projection-like partition portion are formed on the flat portion of the partition plate so that the oil-passing projection portion has its inside communicated with an outlet of the oil passages and has a second communicating hole formed in its inner wall so as to overlap the first communicating hole of the upper tank and so that the projection-like partition portion is attached at its surface onto an inner wall surface of a top portion of the upper tank to thereby partition the inside of the upper tank into an inlet tank chamber and an outlet tank chamber; and a cooling water inflow pipe and a cooling water outflow pipe are connected to the upper tank so as to be communicated with the inlet and outlet tank chambers of the upper tank respectively.

The housingless type oil cooler according to the first aspect of the present invention may further be characterized in that one of the oil filter and the sealed flange is mounted on the top portion of the upper tank so as to be communicated with the inside of the oil-passing projection portion of the partition plate through the first communicating hole of the upper tank and the second communicating hole of the partition plate; and an oil return pipe having at least one opening portion communicated with one of the oil filter and the inside of the sealed flange is disposed so as to pass through the through-hole of the upper tank and the partition plate and the through-holes of the core portion.

In addition, according to a second aspect of the invention, a housingless type oil cooler comprising: a core portion constituted by a plurality of plates respectively having through-holes formed at their center portions, the plates being alternately laminated on one another so that cooling water passages and oil passages are alternately formed between the plates; and one of an oil filter and an sealed flange being mounted on the core portion; is characterized in that: a cylindrical upper tank having an annular flange is put on an upper portion of the core portion to cover the latter; a partition plate is disposed in the inside of the upper tank; a through-hole and an oil passage hole are formed in a flat portion of the partition plate, and a first projection-like partition portion and a second projection-like partition portion are formed on the flat portion of the partition plate so that the first projection-like partition portion is fixedly attached at its surface onto an inner wall surface of the annular flange of the upper tank and has an inlet tank chamber in its inside and the second projection-like partition portion is fixedly attached at its surface onto the inner wall surface of the annular flange of the upper tank and has an outlet tank chamber in its inside; a cooling water inflow pipe is provided so as to pass through the upper tank and the first projection-like partition portion and so as to open in the inlet tank chamber of the partition tank, the cooling water inflow pipe being connected to the upper tank and the first projection-like partition portion; and a cooling water outflow pipe is provided so as to pass through the upper tank and the second projection-like partition portion and so as to open in the outlet tank chamber of the partition tank, the cooling water outflow pipe being connected to the upper tank and the second projection-like partition portion.

The housingless type oil cooler according to the second aspect of the present invention may further be characterized in that one of the oil filter and the sealed flange is mounted on the annular top portion of the upper tank so as to be communicated with a space formed between the upper tank and the partition plate; and an oil return pipe having at least one opening portion communicated with one of the oil filter and the inside of the sealed flange is disposed so as to pass through the upper tank, the through hole of the partition plate and the through holes of the core portion According to the first aspect of the present invention, since the doughnut-like upper tank is supported by the oil-passing projection portion and the projection-like partition portion of the partition plate, deformation of the upper tank is prevented even when the oil filter is strongly fastened against the top portion of the upper tank.

Further, cooling water is led from the cooling water inflow pipe into the inlet tank chamber between the upper tank and the partition plate. After the cooling water from the inlet tank chamber flows into the cooling water passage through the inlet of the cooling water passage so that the cooling water passage is filled with-the cooling water, the cooling water is subjected to heat exchange with the oil in the passage. Then, the cooling water is led from the outlet of the cooling water passage into the outlet tank chamber between the upper tank and the partition plate and flows out into the cooling water outflow pipe.

On the other hand, after oil from the engine side flows into the core portion so that the oil passage is filled with the oil, the oil is led from the outlet of the oil passage into the oil-passing projection, then led from the oil-passing projection into the oil filter through the first communicating hole of the upper tank and the second communicating hole of the partition plate. Then, after cleaned by the oil filter, the cooling water flows out into the oil return pipe.

According to the second aspect of the present invention, the cylindrical upper tank covering the upper portion of the core portion has the annular flange so that the upper tank is fixedly attached to the first and second projection-like partition portions of the partition plate through the annular flange. Accordingly, the upper tank and the partition plate constitute a strong attachment portion of the oil filter so that deformation of the upper tank is prevented even when the oil filter is strongly fastened.

Thus, cooling water is led from the cooling water inflow pipe into the inlet tank chamber in the first projection-like partition portion of the partition plate. After the cooling water from the inlet tank chamber flows into the cooling water passage through the inlet of the cooling water passage so that the cooling water passage is filled with the cooling water, the cooling water is subjected to heat exchange with the oil in the oil passage. Then, the cooling water is led from the outlet of the cooling water passage into the outlet tank chamber in the second projection-like partition portion of the partition tank and flows out into the cooling water outflow pipe.

On the other hand, after oil from the load side flows into the core portion so that the oil passage is filled with the oil, the oil is subjected to heat exchange with the cooling water in the cooling water passage. After the oil is led from the outlet of the oil passage into the oil filter through the space between the partition plate and the upper tank, and after cleaned through the filter, the oil flows out into the oil return pipe.

Further, the present invention has been also made to solve the aforementioned problems and an object thereof is to provide a housingless type oil cooler in which deformation of the oil filter seal surface caused by excessive tightening at the time of attachment of the oil filter is prevented, the height size of the composite tank is reduced, the risk of occurrence of mixing of oil and cooling water is eliminated, and the corrosion-resisting properties of the inner circumferential surfaces of the inlet and outlet tanks of the casing in which cooling water flows can be improved.

According to a third aspect of the present invention, the housingless type oil cooler comprising: a core portion constituted by a plurality of plates respectively having through-holes formed at their center portions, the plate being alternately laminated on one another so that cooling water passages and oil passages are alternately formed between the plates; one of an oil filter and a sealed flange mounted on the core portion through a composite tank; and an oil outflow pipe inserted through the through-holes of the core portion so as to make oil pass through the oil outflow pipe; is characterized in that: the composite tank is constituted by an upper tank and a partition tank which is disposed in the inside of the upper tank so that a flat portion of the partition tank is arranged on the core portion; the upper tank is constituted by an annular top portion for supporting the oil filter, an inner cylindrical portion, and an outer cylindrical portion all of which portions are continuously formed so that a gate shape of the portions is made annular to thereby form a doughnut space inside the portions, the upper tank having a plurality of oil communicating holes formed through the inner cylindrical pipe and an opening portion formed through the inner cylindrical pipe in a position separated by a predetermined distance from the flat portion of the partition tank in a direction of an axis of the core portion; the partition tank has a through-hole, an oil passage hole, a first projection-like partition portion, and a second projection-like partition portion, the through-hole and the oil passage hole being formed through the flat portion, the first and second projection-like partition portions being formed on the flat portion so as to support at their surfaces parts of the annular top portion of the upper tank and having an inlet tank chamber and an outlet tank chamber formed in the respective insides of the first and second projection-like partition portions; a seat connector connected to the opening portion of the upper tank and to the flat portion of the partition tank, the seat connector having an opening hole formed therethrough and being dynamically connected to an inlet end of the oil outflow pipe; a cooling water inflow pipe is provided so as to pass through the upper tank and the first projection-like partition portion and so as to open in the inlet tank chamber of the partition tank, the cooling water inflow pipe being connected to the upper tank and the first projection-like partition portion; and a cooling water outflow pipe is provided so as to pass through the upper tank and the second projection-like partition portion and so as to open in the outlet tank chamber of the partition tank, the cooling water outflow pipe being connected to the upper tank and the second projection-like partition portion.

The housingless type oil cooler according to the third aspect of the present invention may be further characterized in that the oil filter is mounted on the annular top portion of the upper tank so as to be communicated, through the oil communicating holes of the upper tank, with an annular space formed between the upper tank and the partition tank; and an oil return pipe having one opening portion communicated with one of the oil filter and the inside of the sealed flange is disposed so as to pass through the opening hole of the seat connector and the oil outflow pipe.

In the third aspect of the present invention, the housingless type oil cooler may also be characterized in that the partition tank is formed of an aluminum clad material having a sacrifice corrosive layer formed in the inner circumferential side and a brazing material layer formed in the outer circumferential side, and that the upper tank is formed of an aluminum clad material having a brazing material layer formed in the inner circumferential side.

In the third aspect of the present invention, the housingless type oil cooler may be characterized in that the seat connector has an annular flange being in contact with the opening portion of the inner cylindrical portion of the upper tank.

In the third aspect of the present invention, the housingless type oil cooler may be characterized respective top portions of the first and second projection-like partition portions of the partition tank contacting with the inner wall surface of the annular top portion of the upper tank are formed to be flat and are fixed to a part of the inner wall surface of the annular top portion by brazing.

According to a fourth aspect of the present invention, a method for producing a housingless type oil cooler in which a plurality of plates having through-holes formed at their center portions are alternately laminated on one another so as to alternately form cooling water passages and oil passages between the plates to thereby form a core portion made of aluminum, in which a composite tank of aluminum is mounted on the core portion so as to partition cooling water and oil, and in which an oil outflow pipe made of aluminum for making oil flow therethrough is inserted through through-holes of the core portion; is characterized by comprising the steps of: constituting a composite tank by an upper tank and an partition tank which is provided in the upper tank and which has a flat portion disposed on the core portion; continuously forming an annular top portion for supporting one of the oil filter and the sealed flange, an inner cylindrical portion, and an outer cylindrical portion to constitute the upper tank so that a gate shape of the portions is made annular to thereby form a doughnut space inside the portions, and forming a plurality of oil communicating holes through the inner cylindrical pipe, and further forming an opening portion through the inner cylindrical pipe in a position separated by a predetermined distance from the flat portion of the partition tank in a direction of an axis of the core portion; forming a through-hole and an oil passage hole through the flat portion of the partition tank, and forming a first projection-like partition portion and a second projection-like partition portion on the flat portion so as to support at their surfaces parts or the annular top portion of the upper tank and so as to define an inlet tank chamber and an outlet tank chamber in the respective insides thereof; putting the partition tank in the upper tank and mounting the assembly of the partition tank and the upper tank on the core portion; inserting a seat connector having an opening portion formed therethrough into the opening portion of the upper tank of the composite tank; radially expanding the oil outflow pipe and the seat connector to thereby temporarily fix the core portion and the composite tank with each other; and fixedly brazing the seat connector to the flat portion of the partition tank in the above condition of temporarily fixing to thereby integrate the composite tank and the core portion with each other.

In the housingless type oil cooler according to the third aspect of the present invention, the upper tank mounted on the core portion is provided as a closed-space rigid matter obtained by integrating the upper tank and the partition tank with each other through the seat connector. Force acting on the upper tank of the composite tank at the time of tightening of the oil filter is transmitted to the oil outflow pipe through the seat connector so that force acting on the upper surface of the core portion from the upper tank is reduced.

Because not only the upper tank is fixed to the first and second projection-like partition portions of the partition tank through the annular top portion thereof but the opening portion of the inner cylindrical portion of the upper tank is supported by the flat portion of the partition tank through the seat connector, the upper tank, the partition tank and the seat connector form a strong mount portion for the oil filter.

Accordingly, even in the case where the oil filter is tightened strongly, deformation of the upper tank constituting an oil filter sealing surface is reduced.

Thus, cooling water is led from the cooling water inflow pipe into the inlet tank chamber in the first projection-like partition portion of the partition tank. After the cooling water from the inlet tank chamber flows into the cooling water passage through the inlet of the cooling water passage so that the cooling water passage is filled with the cooling water, the cooling water is subjected to heat exchange with the oil in the oil passage. Then, the cooling water is led from the outlet of the cooling water passage into the outlet tank chamber in the second projection-like partition portion of the partition tank and flows out into the cooling water outflow pipe.

On the other hand, after oil from the load side flows into the core portion so that the oil passage is filled with the oil, the oil is subjected to heat exchange with the cooling water in the cooling water passage. After the oil is led from the outlet of the oil passage into the annular space of the upper tank and further passes through the oil communicating holes of the upper tank, the oil is cleaned and flows out into the oil return pipe.

In the housingless type oil cooler of the third aspect of the present invention, because the partition tank may be formed of an aluminum clad material having a sacrifice corrosive layer formed in the inner circumferential side and a brazing material layer formed in the outer circumferential side and because the upper tank is formed of an aluminum clad material having a brazing material layer formed in the inner circumferential side, progress of corrosion caused by cooling water with which the inlet and outlet tank chambers are filled is reduced while surface joining of the upper tank and the partition tank by brazing is secured.

In the housingless-type oil cooler according to the present invention, because the seat connector may have an annular flange being in contact with the opening portion of the inner cylindrical portion of the upper tank, the seat connector presses the opening portion of the inner cylindrical portion of the upper tank toward the partition tank through the annular flange so that temporary fixing of the seat connector and the upper tank at the time of assembling of the composite tank and the core portion can be performed so that brazing can be performed securely.

In the housingless type oil cooler according to the third aspect of the present invention, because the respective top portions of the first and second projection-like partition portions of the partition tank being in contact with the inner wall surface of the annular top portion of the upper tank may be formed so as to be flat and are fixed to a part of the inner wall surface of the annular top portion by brazing, not only the range of surface contact between the upper tank and the partition tank for brazing is reduced to the irreducible minimum but the range of brazing is provided as a surface.

In the fourth aspect of the present invention, the method of producing a housingless type oil cooler in which a plurality of plates having through-holes formed at their center portions are alternately laminated on one another so as to alternately form cooling water passages and oil passages between the plates to thereby form a core portion made of aluminum, in which a composite tank of aluminum is mounted on the core portion so as to partition cooling water and oil, and in which an oil outflow pipe made of aluminum for making oil flow therethrough is inserted through through-holes of the core portion; comprises the steps of: constituting a composite tank by an upper tank and an partition tank which is provided in the upper tank and which has a flat portion disposed on the core portion; continuously forming an annular top portion for supporting the oil filter, an inner cylindrical portion, and an outer cylindrical portion to constitute the upper tank so that a gate shape of the portions is made annular to thereby form a doughnut space inside the portions, and forming a plurality of oil communicating holes through the inner cylindrical pipe, and further forming an opening portion through the inner cylindrical pipe in a position separated by a predetermined distance from the flat portion of the partition tank in a direction of an axis of the core portion; forming a through-hole and an oil passage hole through the flat portion of the partition tank, and forming a first projection-like partition portion and a second projection-like partition portion on the flat portion so as to support at their surfaces parts of the annular top portion of the upper tank and so as to define an inlet tank chamber and an outlet tank chamber in the respective insides thereof; putting the partition tank in the upper tank and mounting the assembly of the partition tank and the upper tank on the core portion; inserting a seat connector having an opening portion formed therethrough into the opening portion of the upper tank of the composite tank; radially expanding the oil outflow pipe and the seat connector to thereby temporarily fix the core portion and the composite tank with each other; and fixedly brazing the seat connector to the flat portion of the partition tank in the above condition of temporarily fixing to thereby integrate the composite tank and the core portion with each other.

DETAILED DESCRIPTION OF THE PREFERRED EMBODIMENTS

Figure 1:
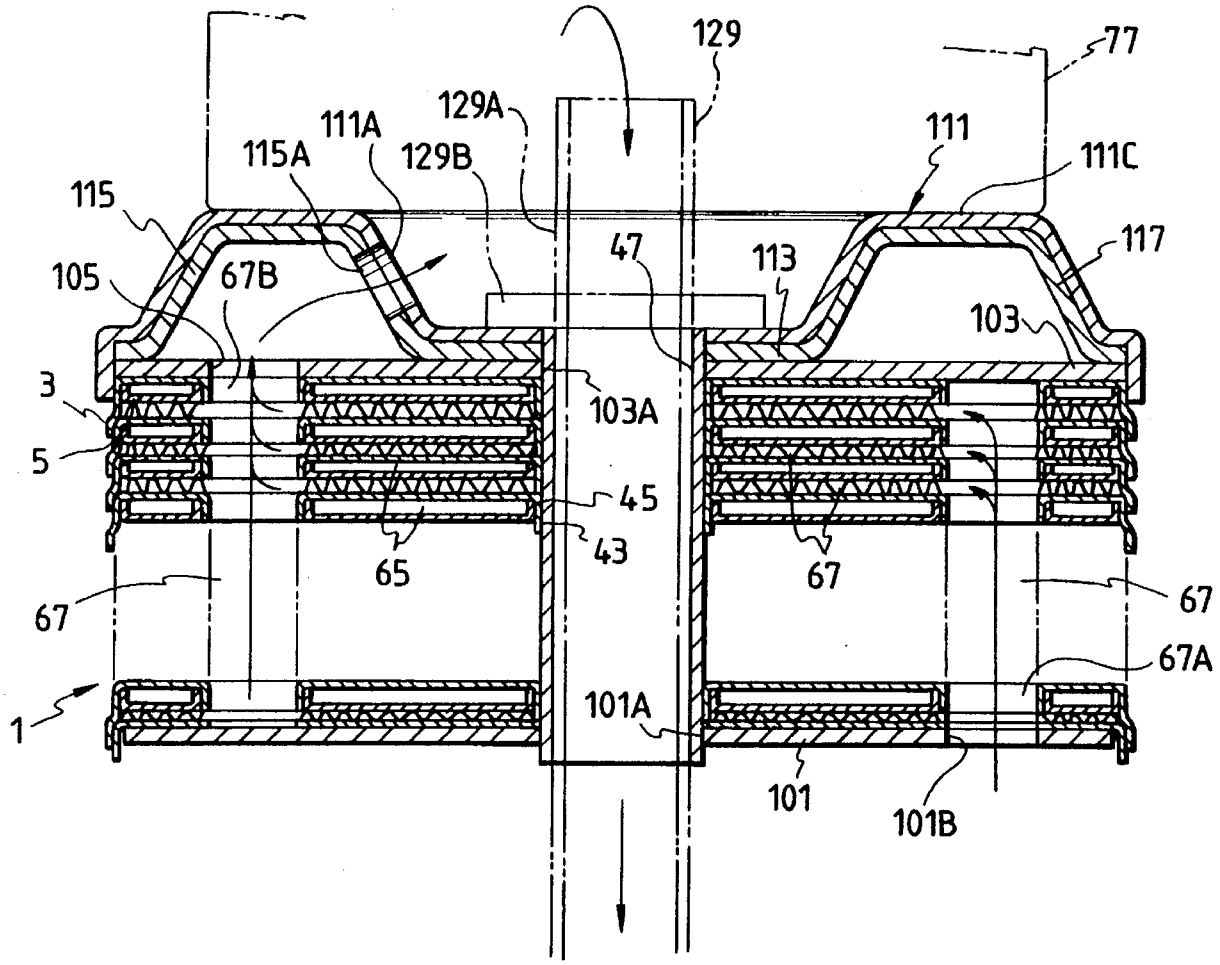
FIG. 1 is a longitudinal sectional view showing a flow of oil side in an oil cooler according to a first embodiment of the present invention.
Figure 2:
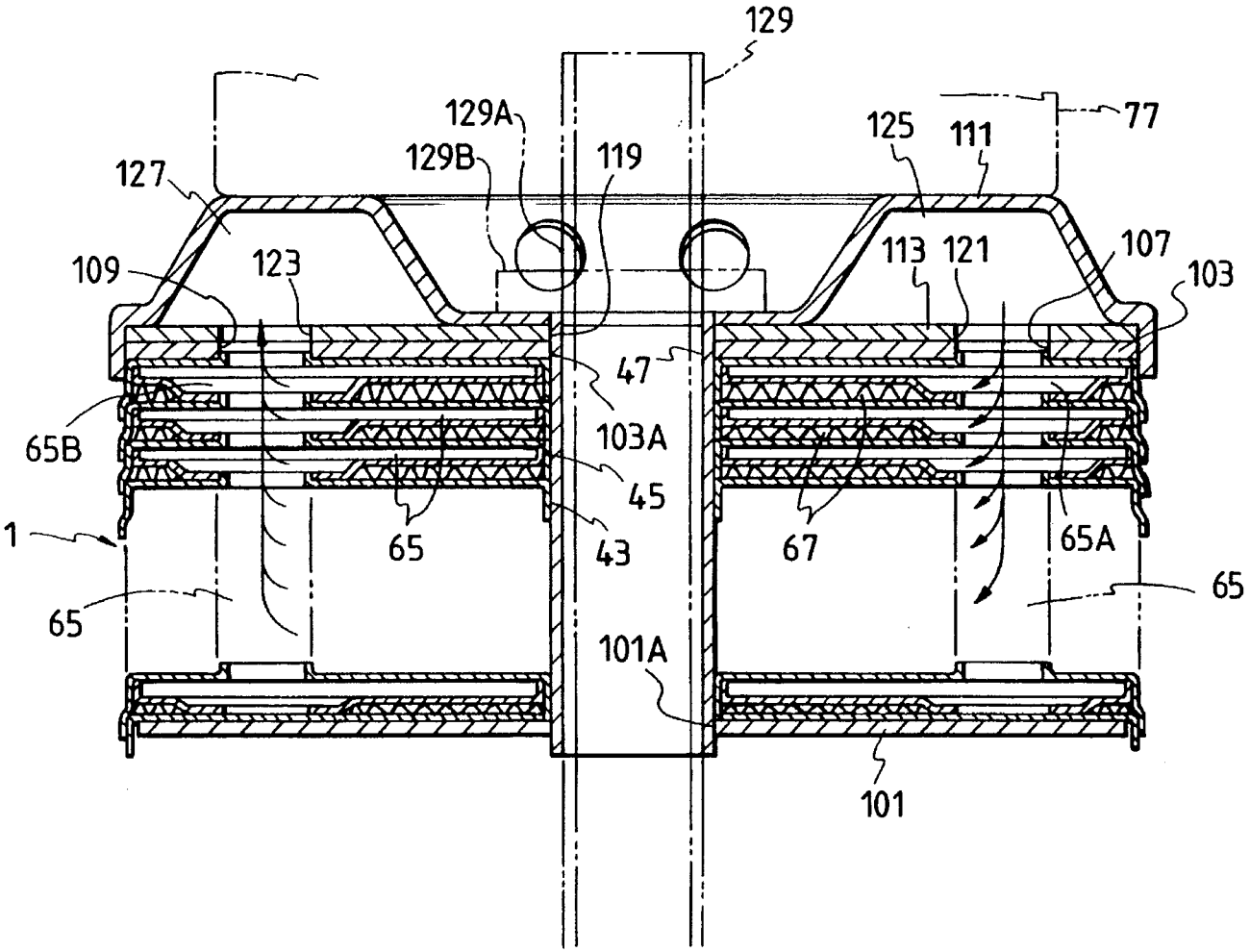
FIG. 2 is a longitudinal sectional view showing a flow of cooling water side in the same oil cooler.
Figure 3:
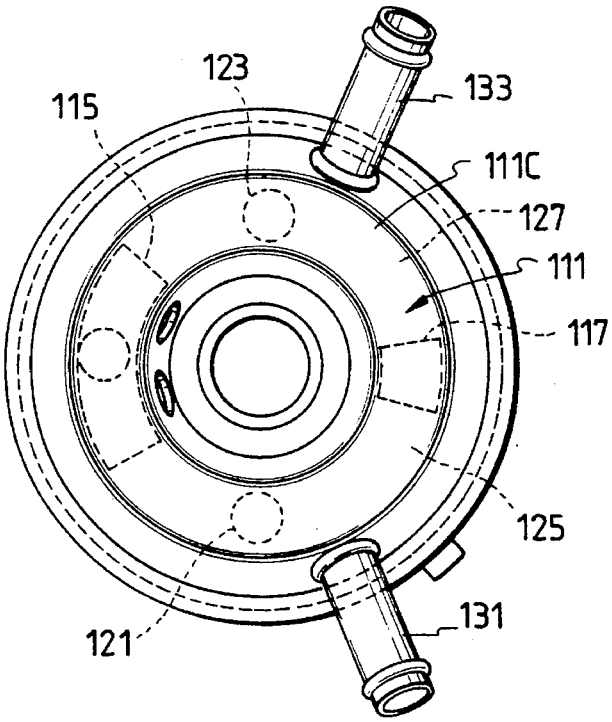
FIG. 3 is a plan view of the same oil cooler.
Figure 4:
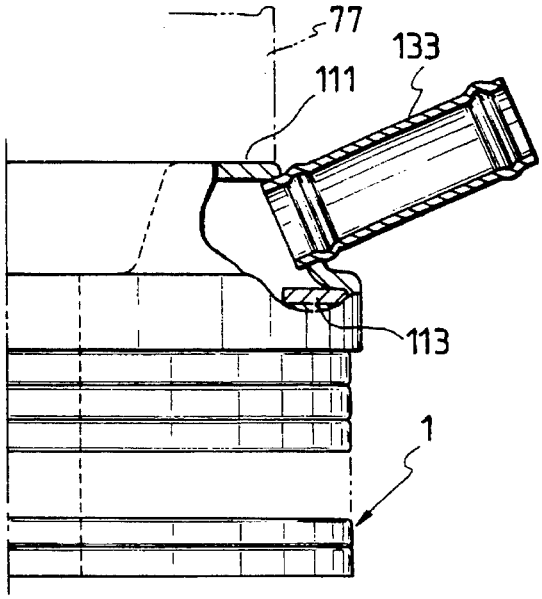
FIG. 4 is a side view showing, partly in section, the same oil cooler.

Embodiments of the present invention will be described below in detail with reference to the drawings.

Referring to FIGS. 1 through 4, an oil cooler according to a first embodiment of the present invention will be described. Only a portion in which this embodiment is different from the prior ark will be described. Like numerals refer to like constituent parts for omission of the description thereof.

In the drawings, the oil cooler according to the embodiment of the present invention has a core portion 1 having the same structure as that in the prior art. In the core portion 1, first and second plates 3 and 5 having through-holes 43 and 45 formed at their center portions respectively are laminated alternately so that cooling water passages 65 and oil passages 67 are formed alternately between these plates 3 and 5.

A lower plate 101 made of aluminum is disposed in a lower portion of the core portion 1. A through-hole 101A is formed at a center portion of the lower plate 101. An oil inflow port 101B communicated with an inlet 67A of one oil passage 67 is formed so as to be placed in a side of the through-hole 101A. A lower end of the other oil passage 67 in the core portion 1 is blocked by the lower plate 101.

On the other hand, an upper plate 103 made of aluminum is disposed in an upper portion of the core portion 1. A through-hole 103A is formed at a center portion of the upper plate 103. An oil outflow port 105 communicated with an outlet 67B of the other oil passage 67 is formed so as to be placed on a side of the through-hole 103A. Further, a cooling water inflow port 107 and a cooling water outflow port 109 communicated with an inlet 65A of the cooling water passages 65 and an outlet 65B thereof respectively are formed in the upper plate 103.

An upper tank 111 is mounted on the upper portion of the core portion 1. A partition tank 113 is disposed in the inside of the upper tank 111. The upper tank 111 is opened in its lower side so as to be shaped like a donut. First communicating holes 111A, 111A are formed in an inner wall of the upper tank 111. Mount holes 111B, 111B are formed in an outer wall of the upper tank 111.

An oil-passing projection portion 115 and a projection-like partition portion 117 are formed in the aforementioned partition plate 113 and, at the same time, a through-hole 119 is formed at the center of the partition plate 113 and an inlet hole 121 and an outlet hole 123 overlapping a cooling water inflow port 107 and a cooling water outflow port 109 respectively are formed in opposite sides of the through-hole 119.

The inside of the oil-passing projection portion 115 is communicated with an outlet 67B of the oil passages 67 through oil outflow holes 105. A second communicating hole 115A overlapping the first communicating hole 111A of the upper tank 111 is formed in the inner wall of the oil-passing projection portion 115.

The projection-like partition portion 117 is surface-fixed to the inner wall surface of the top portion 111C of the upper tank 111 by brazing welding to thereby partition space between the upper tank 111 and the partition plate 113 into an inlet tank chamber 125 and an outlet tank chamber 127.

A cooling water inflow pipe 131 and a cooling water outflow pipe 133 are connected to the upper tank 111 so as to be communicated with the inlet and outlet tank chambers 125 and 127 in the upper tank 111 respectively.

The oil filter 77 is mounted on the top portion 111C of the upper tank 111 so as to communicate with the inside of the oil-passing projection portion 115 of the partition plate 113 through the first communicating hole 111A of the upper tank 111 and the second communicating hole 115A of the partition plate 113.

Further, an oil return pipe 129 constituted by a stud bolt is inserted in the core portion reinforcement pipe 47 so that one end opening thereof is communicated with the oil filter (77). The oil return pipe 129 is attached so as to pass through the through-hole 43 of the first plate 3 of the core portion 1 and the through-hole 45 of the second plate 5 of the core portion 1 from the opening hole of the upper tank 111, the through-hole 119 of the partition plate 113 and the through-hole 103A of the upper plate 103, so that oil is refluxed from the oil filter to the engine side. The core portion 1 is fixed to a bracket (not shown) by screwing a nut 129B with a screw portion 129A formed in an upper portion of the oil return pipe 129.

Thus, in this embodiment, cooling water is led from the cooling water inflow pipe 131 into the inlet tank chamber 125 between the upper tank 111 and the partition plate 113. After the cooling water from the inlet tank chamber 125 flows into the cooling water passage 65 through the inlet 65A of the cooling water passage 65 so that the cooling water passage 65 is filled with the cooling water, the cooling water is subjected to heat exchange with the oil in the oil passage 67. Then, the cooling water is led from the outlet 65B of the cooling water passage 65 into the outlet tank chamber 127 between the upper tank 111 and the partition plate 113 and flows out into the cooling water outflow pipe 133.

On the other hand, after oil from the engine side flows into the core portion 1 so that the oil passage 67 is filled with the oil, the oil is subjected to heat exchange with the cooling water in the cooling water passage 65 and then led from the outlet 67B of the oil passage 67 into the oil-passing projection portion 115 of the partition plate 113. Then, the oil is further led from the oil-passing projection portion 115 to the oil filter 77 through the first communicating hole 111A of the upper tank 111 and the second communicating hole 115A of the partition plate 113. After cleaned thus, the oil flows out into the oil return pipe 129.

According to the aforementioned configuration, because the oil filter is mounted on the top portion 111C of the upper tank 111 shaped like a donut and because the upper tank 111 is supported by the oil passing projection portion 115 and the projection-like partition portion 117 of the partition plate 113, the top portion 111C of the upper tank 111 constituting an oil filter seal surface is never deformed so that occurrence of oil leaking can be prevented even in the case where the oil filter is tightened strongly.

In detail, because the oil-passing projection portion 115 and the projection-like partition portion 117 are integrated with the partition plate 113, the partition plate 113 is formed to have a so-called shell structure. Accordingly, the partition plate 113 is high in stiffness so that deformation of the upper tank 111 at the time of tightening of the oil filter 77 can be suppressed even in the case where force from the oil filter 77 is received through the upper tank 111.

Further, because tank portions by which oil and cooling water are separated are formed on the core portion 1 when the partition plate 113 is fixed to the inner wall surface of the top portion 111C of the upper tank ill by brazing welding while the partition plate 113 is put in the inside of the upper tank 111, assembling of tank portions is made easy so that efficiency in assembling of tank portions can be improved.

Further, because oil and cooling water are separated through the oil-passing projection portion 115 integrally formed in the partition plate 113, the necessity of providing a partition plate by welding or the like to separate oil and cooling water is eliminated so that the separation thereof can be performed securely.

Further, because the inside of the upper tank 111 is separated through the projection-like partition plate 117 of the partition plate 113 surface-fixed to the inner wall surface of the top portion 111C of the upper tank 111, cooling water on the inlet tank chamber 125 side and cooling water on the outlet tank chamber 127 side can be separated securely.

Although this embodiment has shown the case where the upper plate 103 in which the through-hole 103A, the oil outflow port 105, the cooling water inflow port 107 and the cooling water outflow port 109 are formed is disposed in the upper portion of the core portion 1, the present invention can be applied to the case where the upper plate 103 having such structure is not provided as long as the plate thickness of the partition tank 113, or the like, can be selected suitably.

Figure 8:
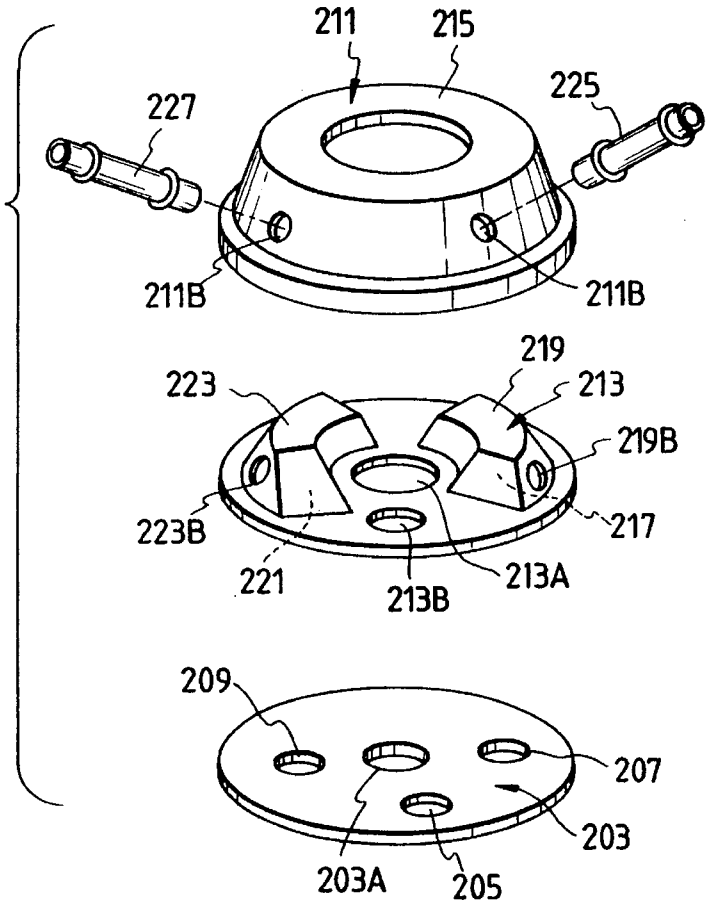
FIG. 8 is an exploded perspective view showing the same oil cooler.
Figure 5:
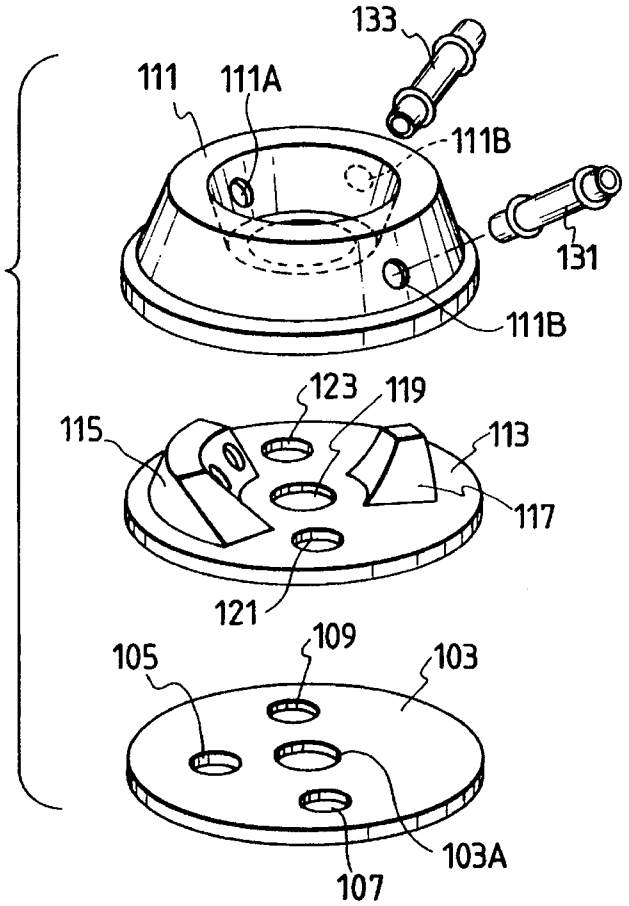
FIG. 5 is an exploded perspective view showing the same oil cooler.
Figure 6:
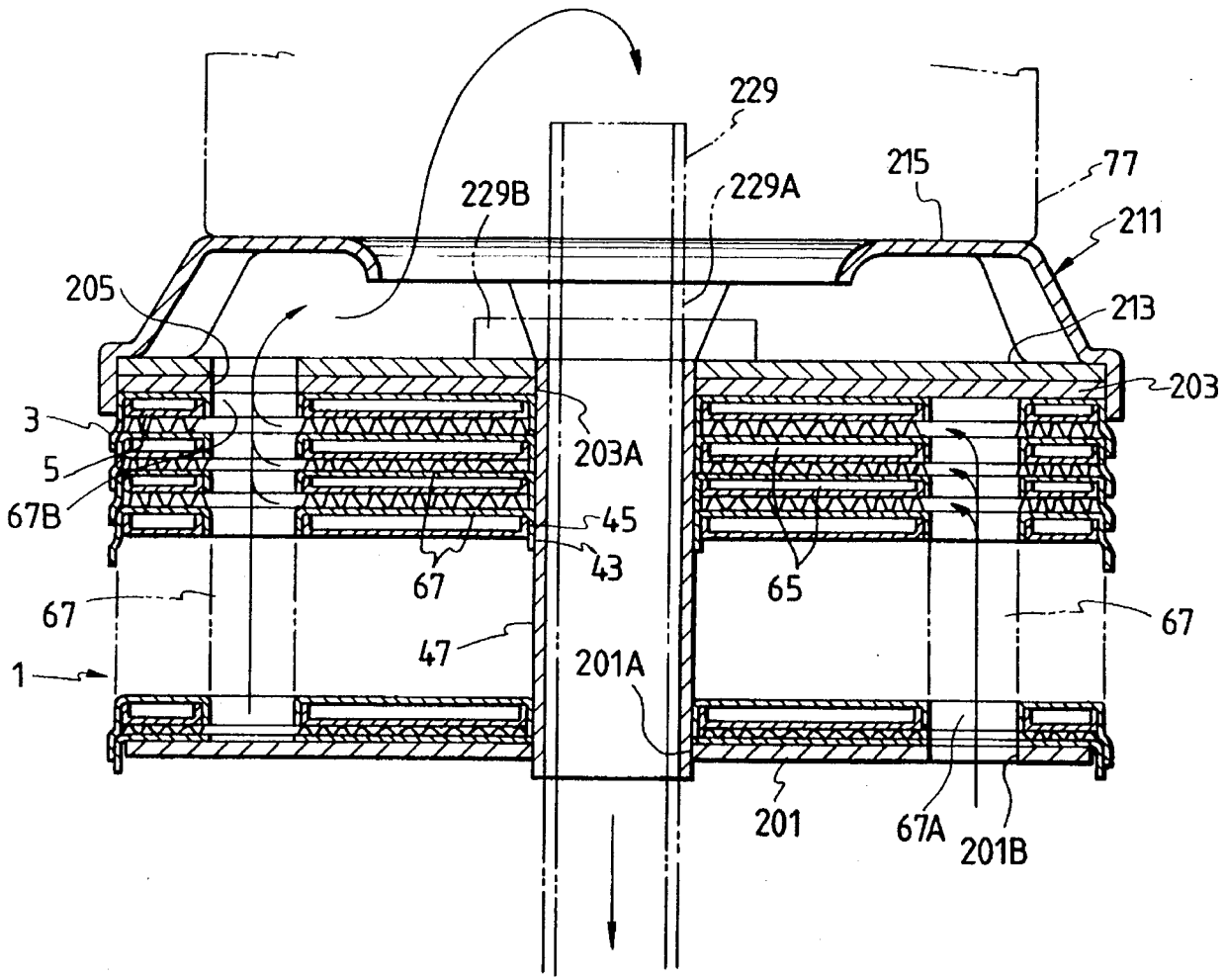
FIG. 6 is a longitudinal sectional view showing a flow of oil side in an oil cooler according to a second embodiment of the present invention.
Figure 7:
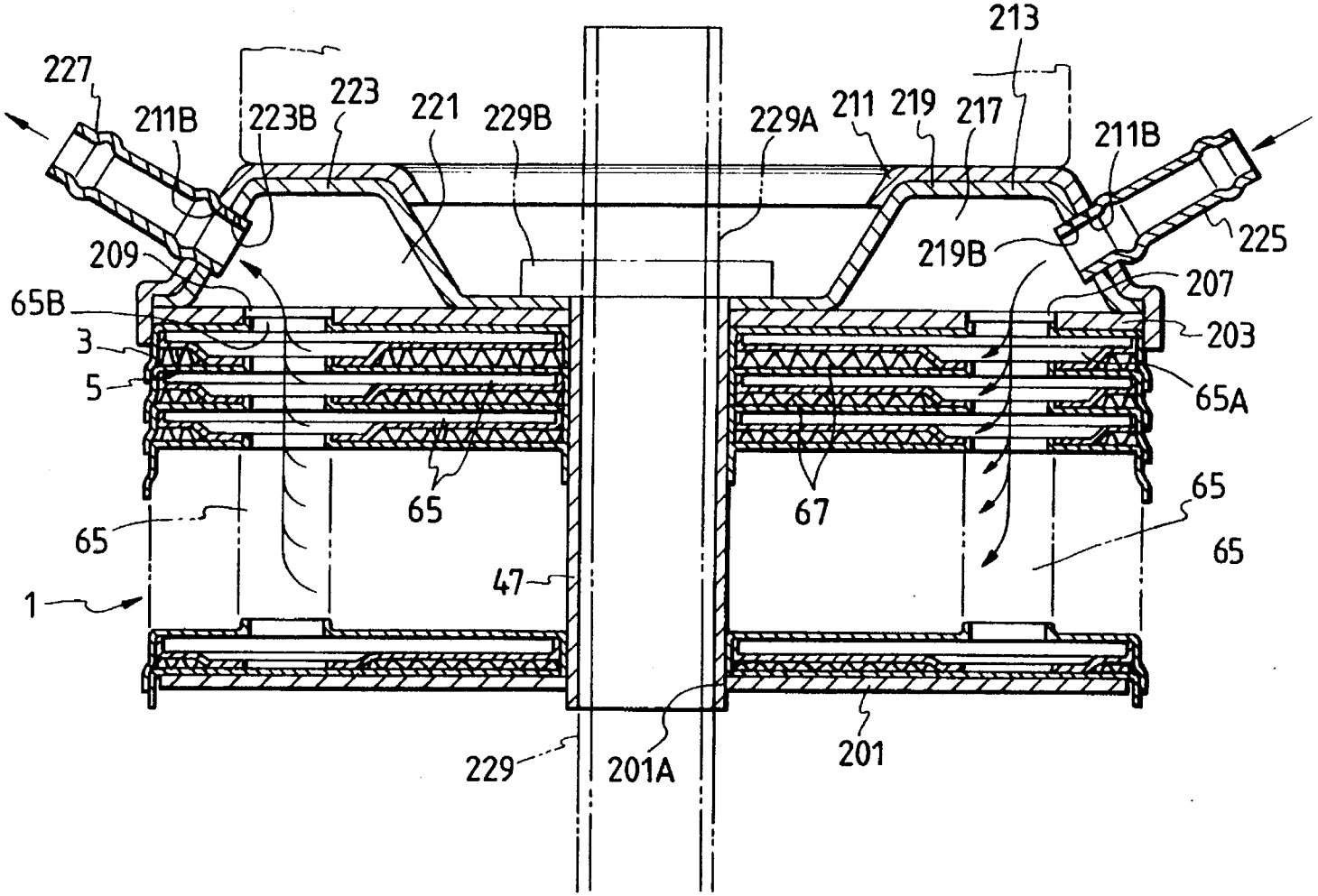
FIG. 7 is a longitudinal sectional view showing a flow of cooling water side in the same oil cooler.

An oil cooler according to a second embodiment of the present invention will be described below in detail with reference to FIGS. 6 through 8. Only a portion in which this embodiment is different from the prior art will be described, and the same constituent parts are correspondingly referenced for omission of the description thereof.

In the drawings, the oil cooler according to the embodiment of the present invention has a core portion 1 having the same structure as that In the prior art. In the core portion 1, first and second plates 3 and 5 having through-holes 43 and 45 formed at their center portions respectively are laminated alternately so that cooling water passages 65 and oil passages 67 are formed alternately between these plates 3 and 5.

A lower plate 201 made of aluminum is disposed in a lower portion of the core portion 1. A through-hole 201A is formed at a center portion of the lower plate 201. An oil inflow port 201B communicated with an inlet 67A of one oil passage 67 is formed so as to be placed in a side of the through-hole 201A. A lower end of the other oil passage 67 in the core portion 1 is blocked by the lower plate 201.

On the other hand, an upper plate 203 made of aluminum is disposed in an upper portion of the core portion 1. A through-hole 203A is formed at a center portion of the upper plate 203. An oil outflow port 205 communicated with an outlet 67B of the other oil passage 67 is formed so as to be placed on a side of the through-hole 203A. Further, a cooling water inflow port 207 and a cooling water outflow port 209 communicated with an inlet 65A of the cooling water passages 65 and an outlet 65B thereof respectively are formed in the upper plate 203.

An upper tank 211 is mounted on the upper portion of the core portion 1. A partition plate 213 is disposed in the inside of the upper tank 211.

The upper tank 211 has a seal surface on which the one of the oil filter 77 and the sealed flange 401 is sealingly mounted, and the seal surface is provided with a sacrifice corrosive layer.

The upper tank 211 is formed so as to be cylindrical, so as to have an annular flange 215, and so as to put on the upper portion of the core portion 1 to cover the latter. Mount holes 211B and 211B are formed in the outer side wall of the upper tank 211.

A through-hole 213A and an oil passage hole 213B are formed through a flat portion of the partition plate 213. A first projection-like partition portion 219 and a second projection-like partition portion 223 are formed on the partition plate 213 so that the first projection-like partition portion 219 is fixedly attached at its surface onto an inner wall surface of the annular flange 215 of the upper tank 211 and has an inlet tank chamber 217 in the inside thereof, and the second projection-like partition portion 223 is fixedly attached at its surface onto the inner wall surface of the annular flange 215 of the upper tank 211 and has an outlet tank chamber 221 in the inside thereof. A space between the upper tank 211 and the partition plate 213 is made to be a space through which oil passes.

The first and second projection-like partition portions 219 and 223 of the partition plate 213 are provided with mount holes 219B and 223B formed so as to overlap the mount holes 211B and 211B of the upper tank 211 respectively, Further, a cooling water inflow pipe 225 and a cooling water outflow pipe 227 communicated with the inlet and outlet tank chambers 217 and 221 of the upper tank 211 are put in the mount holes 211B and 211B of the upper tank 211 and the mount holes 219B and 223B of the partition plate 213 and fixedly connected to the upper tank 211 and the partition plate 213, respectively.

The oil filter 77 is mounted on the annular flange 215 of the upper tank 211 and communicated with oil-passing space between the partition plate 213 and the upper tank 211.

Further, an oil return pipe 229 constituted by a stud bolt is inserted in the core portion reinforcement pipe 47. The oil return pipe 229 is attached so as to pass through the through-hole 213A of the partition plate 213, the through-hole 43 of the first plate 3 of the core portion 1 and the through-hole 45 of the second plate 5 of the core portion 1 from the opening hole of the upper tank 211, so that oil from the oil return pipe 229 is refluxed to the engine side. The core portion 1 is fixed to a bracket (not shown) by screwing a nut 229B with a screw portion 229A formed in an upper portion of the oil return pipe 229.

Thus, in this embodiment, cooling water is led from the cooling water inflow pipe 225 into the inlet tank chamber 217 in the first projection-like partition portion 219 of the partition plate 213. After the cooling water from the inlet tank chamber 217 flows into the cooling water passage 65 through the inlet 65A of the cooling water passage 65 so that the cooling water passage 65 is filled with the cooling water, the cooling water is subjected to heat exchange with the oil in the oil passage 67. Then, the cooling water is led from the outlet of the cooling water passage 65 into the outlet tank chamber 221 in the second projection-like partition portion 223 of the partition plate 213 and flows out into the cooling water outflow pipe 227.

On the other hand, after oil from the engine side flows into the core portion so that the oil passage 67 is filled with the oil, the oil is subjected to heat exchange with the cooling water in the cooling water passage 65 and then led from the outlet 65B of the oil passage 67 to the oil filter 77 through a space between the projection plate 213 and the upper tank 211. After cleaned thus, the oil flows out into the oil return pipe 229.

According to this embodiment, because the upper tank 211 mounted on the upper portion of the core portion 1 has an annular top portion 215 through which the upper tank 211 is fixedly supported to the first and second projection-like partition portions 219 and 223 of the partition plate 213, the upper tank 211 and the partition plate 213 form a strong mount portion for the oil filter 77. Accordingly, the upper tank 211 constituting an oil filter 77 seal surface is never deformed so that occurrence of oil leaking can be prevented.

In detail, because the first projection-like partition portion 219 and the second projection-like partition portion 223 are integrated with the partition plate 213, the partition plate 213 is formed to have a so-called shell structure. Accordingly, the partition plate 213 is high in stiffness so that deformation at the time of tightening of the oil filter 77 can be suppressed even in the case where force from the oil filter is received through the upper tank 211.

Further, according to this embodiment, because the cooling water inflow pipe 225 and the cooling water outflow pipe 227 are fixed by the upper tank 211 and the partition plate 213, strength in mounting of the cooling water inflow pipe 225 and the cooling water outflow pipe 227 can be improved.

Although this embodiment has shown the case where the upper plate 203 in which the through-hole 203A, the oil outflow port 205, the cooling water inflow port 207 and the cooling water outflow port 209 are formed is disposed in the upper portion of the core portion 1, the present invention can be applied to the case where the upper plate 203 having such structure is not provided as long as the plate thickness of the partition tank 213, or the like, can be selected suitably.

As described above, according to the first aspect of the present invention, because the oil filter is mounted on the top portion of the upper tank formed like a doughnut and the upper tank is supported at least by the projection-like partition portions of the partition plate, the top portion of the upper tank constituting an oil filter seal surface does not bend even if the oil filter is strongly fastened so that occurrence of oil leakage can be prevented.

Further, according to the second aspect of the present invention, because the cylindrical upper tank mounted on the upper portion of the core portion has an annular flange portion so that the upper tank is fixedly attached to and supported by the first and second projection-like partition portions through the annular flange, the upper tank and the partition plate constitute a strong mount attachment portion of the oil filter. Accordingly, the upper tank constituting an oil filter seal surface is not be deformed even if the oil filter is strongly fastened so that occurrence of oil leakage can be prevented.

Further, a third embodiment of the present invention will be described below in detail with reference to the drawings.

Referring to FIGS. 9A and 10 through 15, a housingless oil cooler and a method for producing the same according to an third aspect and fourth aspect of the present invention will be described. Only a portion in which the third embodiment is different from the prior art will be described. Like numerals refer to like constituent parts for omission of the description thereof.

In the drawings, the housingless oil cooler according to the embodiment of the present invention has a core portion 1 having the same structure as that in the prior art. In the core portion 1, first and second plates 3 and 5 having through-holes 43 and 45 formed at their center portions respectively are laminated alternately so that cooling water passages 65 and oil passages 67 are formed alternately between these plates 3 and 5.

A lower plate 301 made of aluminum is disposed in a lower portion of the core portion 1. A through-hole 301A is formed at a center portion of the lower plate 301. An oil inflow port 301B communicated with an inlet 67A of one oil passage 67 is formed so as to be placed in a side of the through-hole 301A. A lower end of the other oil passage 67 in the core portion 1 is blocked by the lower plate 301.

On the other hand, an upper plate 303 made of aluminum is disposed in an upper portion of the core portion 1. A through-hole 303A is formed at a center portion of the upper plate 303. An oil outflow port 305 communicated with an outlet 67B of the other oil passage 67 is formed so as to be placed on a side of the through-hole 303A. Further, a cooling water inflow port 307 and a cooling water outflow port 309 communicated with an inlet 65A of the cooling water passages 65 and an outlet 65B thereof respectively are formed in the upper plate 303.

An upper tank 311 is mounted on the upper portion of the core portion 1. A partition tank 313 is disposed in the inside of the upper tank 311. The upper tank 311 and the partition tank 313 constitute a composite tank 302. A flat portion 314 (shown by the oblique line in FIG. 14) of the partition tank 313 is mounted on the upper plate 303 of the core portion 1.

The upper tank 311 is constituted by an annular top portion 315 for supporting said oil filter 77, an inner cylindrical portion 316, and an outer cylindrical portion 317 all of which portions 315, 316 and 317 are continuously formed so that a gate shape of the portions 315, 316 and 317 is made annular to thereby form a doughnut space inside the portions 315, 316 and 317. A plurality of oil communicating holes 318 are formed through the inner cylindrical pipe 316 and an opening portion 319 is formed through the inner cylindrical pipe 316 in a position separated by a predetermined distance from the flat portion 314 of the partition tank 313 in a direction of an axis of the core portion.

Mount holes 317B, 317B are formed through the outer cylindrical portion 317 of the upper tank 311.

The partition tank 313 has a through-hole 318A and an oil passage hole 319A formed through the flat portion 314, a first projection-like partition portion 321 formed so as to support a part of the annular top portion 315 of the upper tank 311 at its surface and so as to define an inlet tank chamber 320 in the inside thereof, and a second projection-like partition portion 323 formed so as to support a part of the annular top portion 315 of the upper tank 311 at its surface and so as to define an outlet tank chamber 322 in the inside thereof. The respective top portions of the first and second projection-like partition portions 321 and 323 being in contact with the inner wall surface of the annular top portion 315 of the upper tank 311 are formed so as to be flat and are fixed to a part of the inner wall surface of the annular top portion 315 by brazing. Further, not only the outer surfaces of the first and second projection-like-partition portions 321 and 323 are formed so as to be inclined but the outer cylindrical portion 317 of the upper tank 311 is formed so as to be inclined, so that they can be brought into contact with each other.

An annular space 324 between the upper tank 311 and the partition tank 313 is made to be a space through which oil passes.

The partition tank 313 is formed of an aluminum clad material composed of a sacrifice corrosive layer 313A, a core material 313B, and a brazing material layer 313C, the sacrifice corrosive layer 313A and the brazing material layer 313C being formed on opposite sides of the core material 313B so as to be disposed in the inner circumferential side and in the outer circumferential side respectively. The upper tank 311 is formed of an aluminum clad material having a brazing material layer 311C formed in the inner circumferential side. On the other hand, the upper tank 311 may also be formed of an aluminum clad material having a brazing material layer 311C formed in the inner circumferential side and a sacrifice corrosive layer formed in the outer circumferential side.

The upper plate 303 is formed of an aluminum clad material having brazing material layers 303C, 303C formed in the upper and lower surface sides respectively.

Accordingly, while joining of the surface of the upper tank 311 with the surface of the partition tank 313 by brazing is secured, the respective inner circumferential sides of the first and second projection-like partition portions 321 and 323 in the inlet and outlet tank chambers 320 and 322 filled with cooling water are made to be sacrifice corrosive layers. As a result, the progress of corrosion caused by cooling water with which the inlet and outlet tank chambers 320 and 322 can be suppressed so that the corrosion-resisting properties of the first and second projection-like partition portions 321 and 323 in the inlet and outlet tank chambers 320 and 322 can be improved. The annular space 324 is surrounded by the brazing material layers 311C and 313C but there is no room for production of the corrosion progress problem because the annular space 324 is never filled with cooling water. Although the sacrifice corrosive layer in the inner circumferential side of the flat portion 314 of the partition tank 311 is joined with the brazing material layer 303C of the upper plate 303 by brazing, a portion just above the core portion is made to be in the cooling water side so that a problem in mixing of oil and cooling water can be avoided even in the case where corrosion penetrates.

Further, a seat connector 325 is mounted on the composite tank 302. That is, the seat connector 323 has an opening hole 326 and an annular flange 327 to be brought into contact with the opening portion 319 of the inner cylindrical portion 316 of the upper tank 311 to thereby press the upper tank 311 toward the partition tank 313 and further has a forward end portion 328 for pressing the periphery of the through-hole 318A of the flat portion 314 of the partition tank 313. Further, an inner circumferential step portion 326A is formed in the opening hole 326 so as to be in contact with the oil outflow pipe 47.

In the seat connector 325, not only its forward end portion 328 is joined with the flat portion 314 of the partition tank 313 by brazing but its inner circumferential step portion 326A is joined with the outer circumferential surface of an inlet end 47A of the oil outflow pipe 47. The seat connector 325 connects the opening portion 319 of the upper tank 311 and the flat portion 314 of the partition tank 313 to each other and is dynamically connected to an inlet end of the oil outflow pipe 47.

Accordingly, the seat connector 325 presses the opening portion 319 of the inner cylindrical portion 316 of the upper tank 311 toward the partition tank 313 through the annular flange 327 thereof, so that temporary fixing of the seat connector 325 and the upper tank 311 at the time of assembling of the composite tank 302 and the core portion 1 is made possible. As a result brazing can be performed securely.

Further, the first and second projection-like partition portions 321 and 323 of the partition tank 313 are provided with mount holes 321B and 323B formed so as to overlap the mount holes 317B, 317B of the upper tank 311 respectively.

Further, a cooling water inflow pipe 329 and a cooling water outflow pipe 330 communicated with the inlet and outlet tank chambers 320 and 322 of the upper tank 311 are put in the mount holes 311B, 311B of the upper tank 311 and the mount holes 321B and 323B of the partition tank 313 and fixedly connected to the upper tank 311 and the partition tank 313, respectively.

The oil filter 77 is mounted on the annular top portion 315 of the upper tank 311 so that the oil filter 77 is communicated, through the oil communicating hole 318 of the upper tank 311, with the annular space 324 formed between the upper tank 311 and the partition tank 313.

The oil outflow pipe 47 is mounted so as to be inserted in the through-hole 318A of the partition tank 313, the through-hole 43 of the first plate 3 of the core portion 1 and the through-hole 45 of the second plate 5 of the core portion 1. An oil return pipe 331 having one end opening communicated with the oil filter 77 is disposed so as to be inserted in the opening portion 326 of the seat connector 325 and the oil outflow pipe 47 to thereby return oil to the engine side.

The core portion 1 is fixed to a bracket (not shown) by screwing a nut 332 with a screw portion 331A formed in an upper portion of the oil return pipe 331.

Thus, in the third embodiment, cooling water is led from the cooling water inflow pipe 329 into the inlet tank chamber 320 in the first projection-like partition portion 321 of the partition tank 313. After the cooling water from the inlet tank chamber 320 flows into the cooling water passage 65 through the inlet 65A of the cooling water passage 65 so that the cooling water passage 65 is filled with the cooling water, the cooling water is subjected to heat exchange with the oil in the oil passage 67.

Then, the cooling water is led from the outlet 65B of the cooling water passage 65 into the outlet tank chamber 322 in the second projection-like partition portion 323 of the partition tank 313 and flows out into the cooling water outflow pipe 330.

on the other hand, after oil from the engine side flows into the core portion i so that the oil passage 67 is filled with the oil, the oil is subjected to heat exchange with the cooling water in the cooling water passage 65. After the oil is further led from the outlet 65B of the oil passage 67 to the oil filter 77 through the annular space 324 between the partition tank 313 and the upper tank 311, the oil thus cleaned flows out into the oil return pipe 331.

In the aforementioned housingless type oil cooler, after non-corrosive flux is applied onto respective parts and dried in advance, projection portions 61 and 63 of a second plate 5 are fitted to cylindrical portions 57 and 59 of a first plate 3. Then, a large-size portion 69 of the first plate 3 is fitted to a small-size portion 71 of another first plate 3. Further, an upper plate 303, a lower plate 301 and a mount plate 31 are successively attached thereto. After a core portion 1 is formed by inserting an oil outflow pipe 47 in center through-holes 43 and 44 of the plates 3 and 4, these are mounted on the core portion 1 in the condition in which the partition tank 313 is put in the inside of the upper tank 311.

The upper tank 311 and the partition tank 313 are processed by press forming in advance so that the partition tank 313 is put in the inside of the upper tank 311 so as to be fitted thereto at the time of assembling.

Then, after the oil outflow pipe 47 is inserted in the through-holes 43 and 45 of the plates 3 and 5 of the core portion 1, the core portion 1, the seat connector 325 and the composite tank 302 are fixed temporarily by inserting the seat connector 325 in the opening portion 319 of the upper tank 311 of the composite tank 302 and then giving axial force to the seat connector 325 by a suitable pressing means to widen the oil outflow pipe 47 and the seat connector 325 radially.

In this condition, these are heated in a furnace so that respective parts are brazed. Accordingly, the seat connector 325 is fixed to the flat portion 314 of the partition tank 313 by brazing. Further, a brazing material in the inside of the upper tank 311 enters into the engagement portion between the opening portion 319 of the upper tank 311 and the seat connector 325 so that the upper tank 311 and the seat connector 325 are joined by brazing. As a result, the core portion 1 and the composite tank 302 are integrated with each other through the seat connector 325 to thus produce the housingless type oil cooler. Further, by applying brazing-material-including flux onto the engagement portion between the opening portion 319 of the upper tank 311 and the seat connector 325, joining of the upper tank 311 and the seat connector 325 by brazing can be improved more greatly.

Figure 9A:
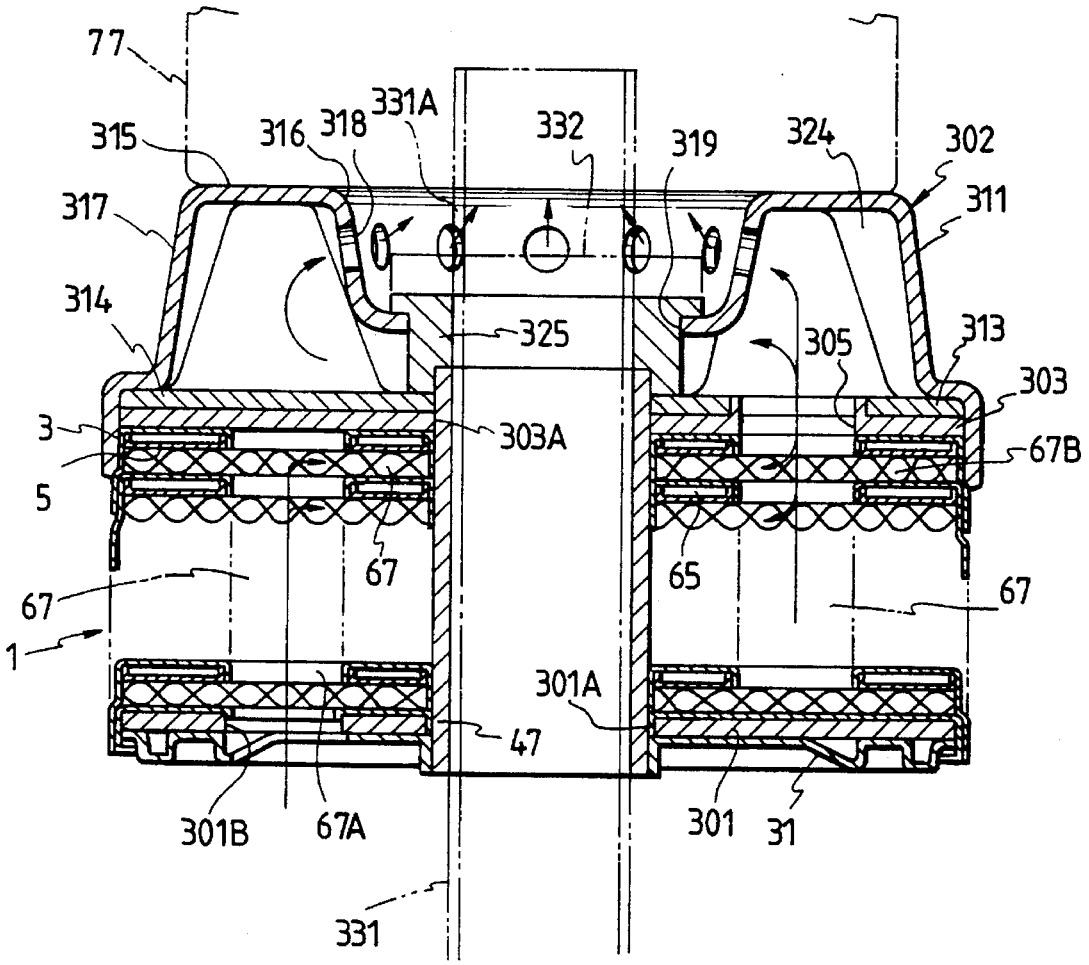
FIG. 9A is a longitudinal sectional view showing a flow of oil in a housingless type oil cooler according to a third embodiment of the present invention.
Figure 9B:
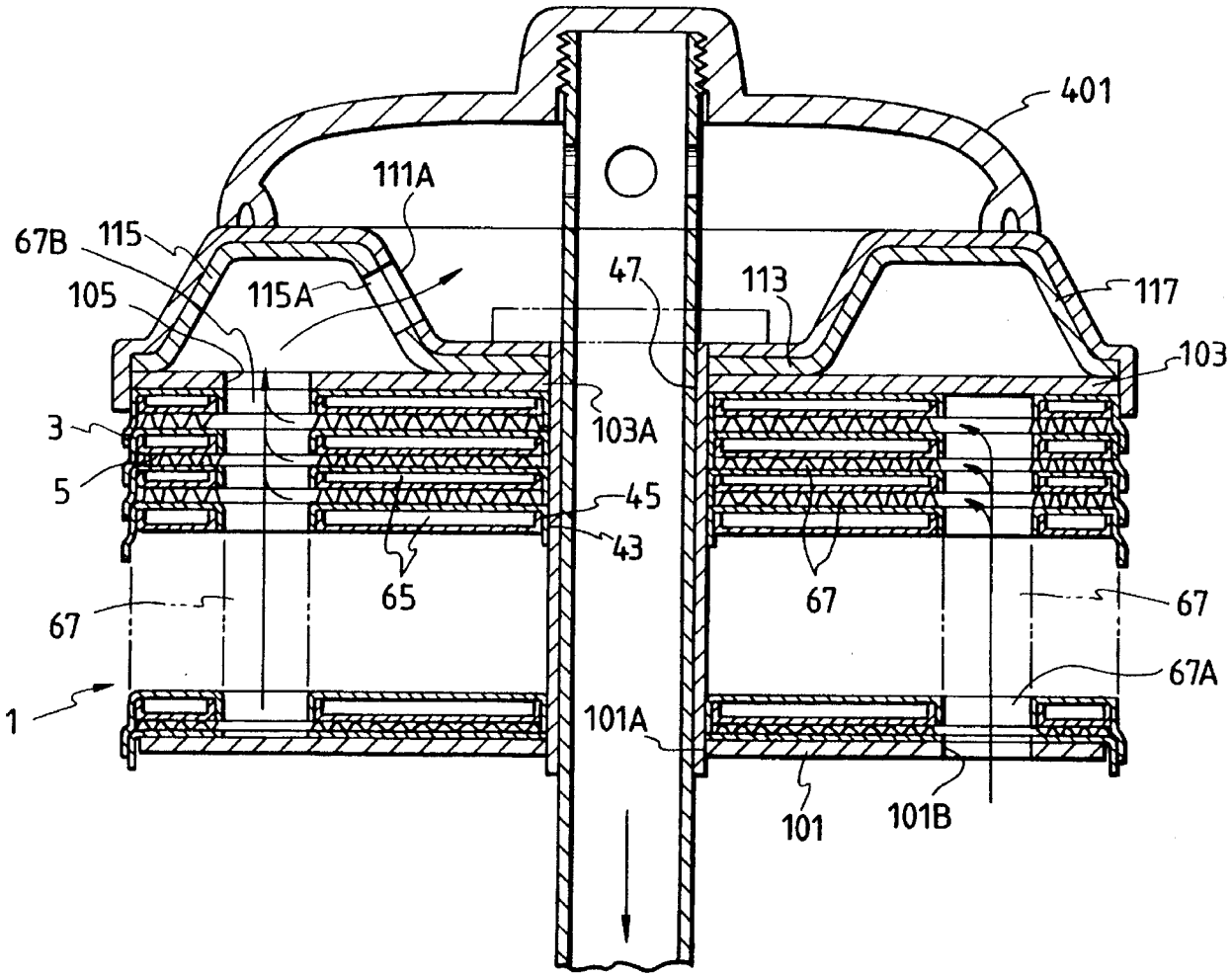
FIG. 9B is a longitudinal sectional view showing a modification of the oil cooler according to the third embodiment of the present invention.
Figure 10:
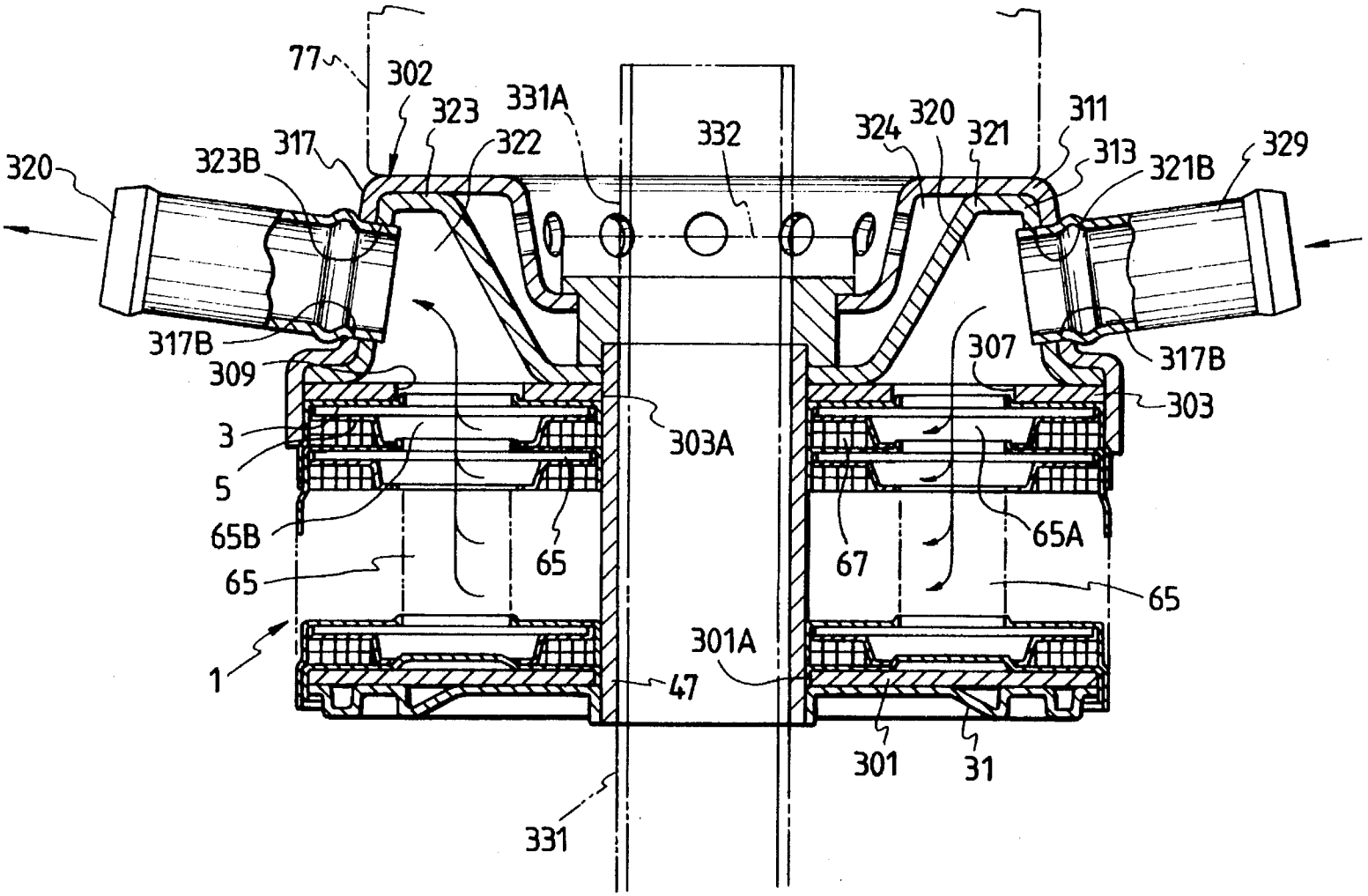
FIG. 10 is a longitudinal sectional view showing a flow of oil in the housingless type oil cooler.
Figure 11:
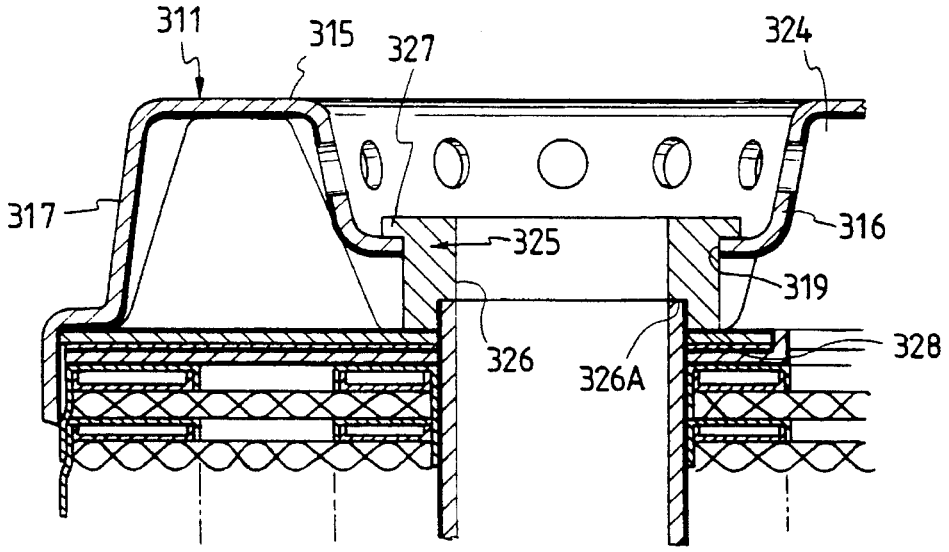
FIG. 11 is a longitudinal sectional view for explaining the brazing state of the oil side of the composite tank in the housingless type oil cooler.
Figure 12:
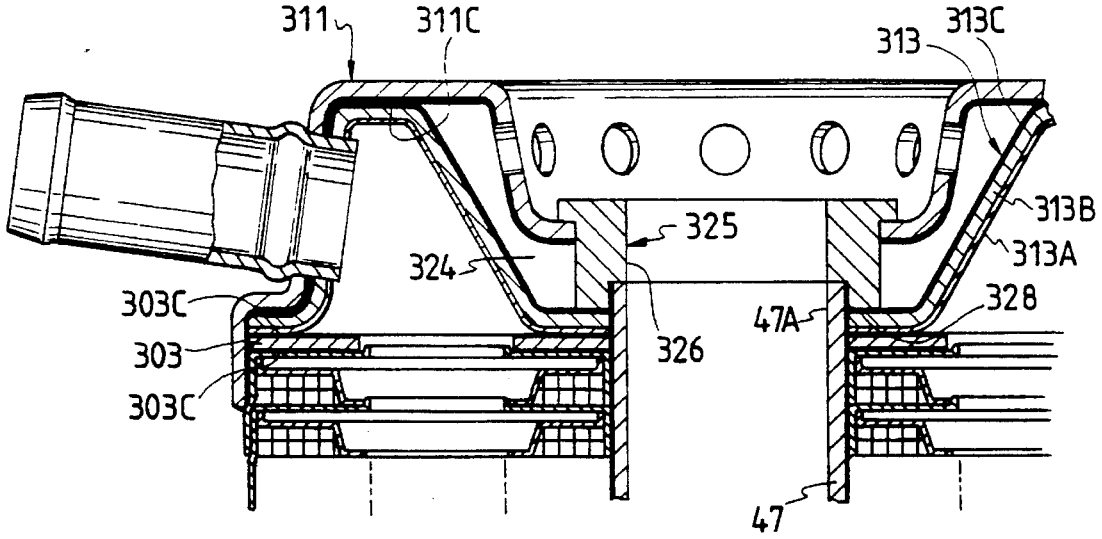
FIG. 12 is a longitudinal sectional view for explaining the brazing state of the cooling water side of the composite tank in the housingless type oil cooler.
Figure 13:
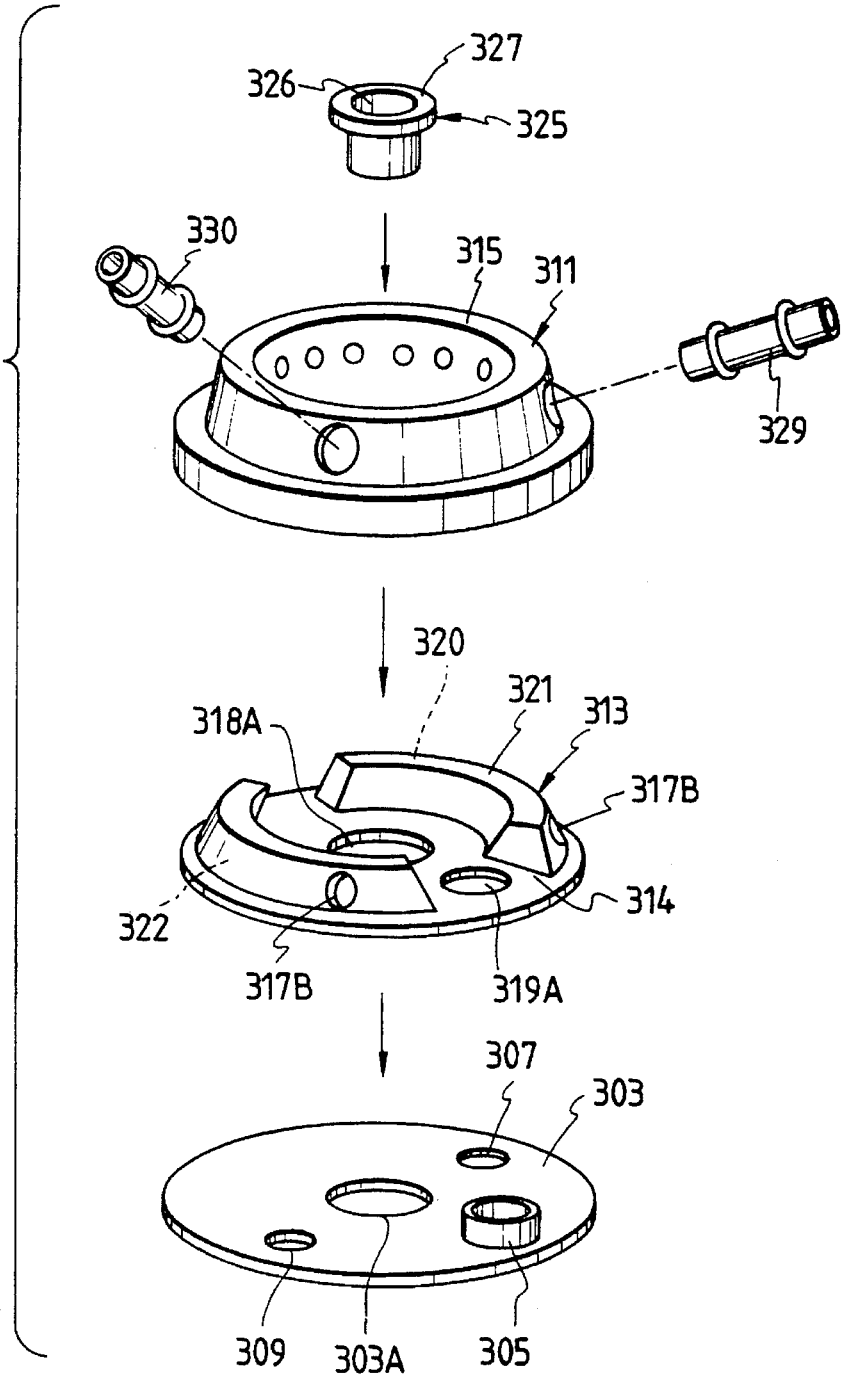
FIG. 13 is an exploded perspective view showing important part of the housingless type oil cooler.

In the oil cooler according to the above-mentioned embodiments of the present invention, the oil filter 77 is mounted on the upper portion of the oil cooler. However, in the case of that the oil cooler of the invention is applied with a transmission gear oil cooler, the oil filter can be replaced by a closed type sealed flange cover 401 as shown in FIG. 9B.

According to the configuration as described above, the following effects are provided.

(1) The upper tank 311 mounted on the upper portion of the core portion 1 is provided as a closed-space rigid matter obtained by integrating the upper tank 311 and the partition tank 313 with each other through the seat connector 125. Because the opening portion 319 of the inner cylindrical portion 316 of the upper tank 311 is connected to the seat connector 325 which is dynamically connected to the oil outflow pipe 47, force acting on the upper tank 311 of the composite tank 302 at the time of tightening of the oil filter 77 is transmitted to the oil outflow pipe 47 through the seat connector 325 so that force acting on the upper surface of the core portion 1 from the upper tank 311 can be reduced.

Because not only the upper tank 311 mounted on the upper portion of the core portion 1 has an annular top portion 315 through which the upper tank 311 is fixedly supported to the first and second projection-like partition portions 321 and 323 of the partition tank 313 but the opening portion 319 of the inner cylindrical portion 316 of the upper tank 311 is supported to the flat portion 314 of the partition tank 313 through the seat connector 325 and because the annular flange 327 of the seat connector 325 is fixed to the opening portion 319 of the upper tank 311 by brazing, the upper tank 311, the partition tank 313 and the seat connector 325 form a strong mount portion for the oil filter 77.

The partition tank 313 is formed by projecting the first and second projection-like partition portions 321 and 323 from the flat portion 314. Force received from the upper tank 311 at the time of tightening of the oil filter 77 is diffused from the respective top portions of the first and second projection-like partition portions 321 and 323 to the periphery of the edge of the flat portion 314 so that force acting on the upper surface of the core portion 1 can be reduced.

Accordingly, even in the case where the oil filter 77 is tightened strongly or even in the case where force from the oil filter 77 is received through the upper tank 311, the upper tank 311 constituting an oil filter sealing surface is never deformed at the time of tightening of the oil filter 77 so that occurrence of oil leaking can be prevented.

Further, because the upper tank 311 and the partition tank 313 are processed by press forming in advance so that the partition tank 313 is put in the inside of the upper tank 311 so as to be fitted thereto at the time of assembling, the height of the composite tank 302 can be reduced without the necessity of surplus height size of the upper tank 311 and the partition tank 313 as conventionally required for absorbing spring-back or sagging even in the case where spring-back or sagging occurs in the upper tank 311 and the partition tank 313. Further, because the partition tank 313 is put in the inside of the upper tank 311 so as to be fitted thereto, the respective shapes of the upper tank 311 and the partition tank 313 need not be formed cylindrically. Accordingly, the cooling water outflow pipe 330 and the cooling water inflow pipe 329 can be attached to the composite tank 302 while the respective side surfaces of the outer cylindrical portion 317 of the upper tank 311 and the first end second projection-like partition portions 321 and 323 of the partition tank 313 are inclined. As a result, the height size of the composite tank 302 can be reduced, so that the size of the housingless oil cooler can be reduced.

Figure 14:
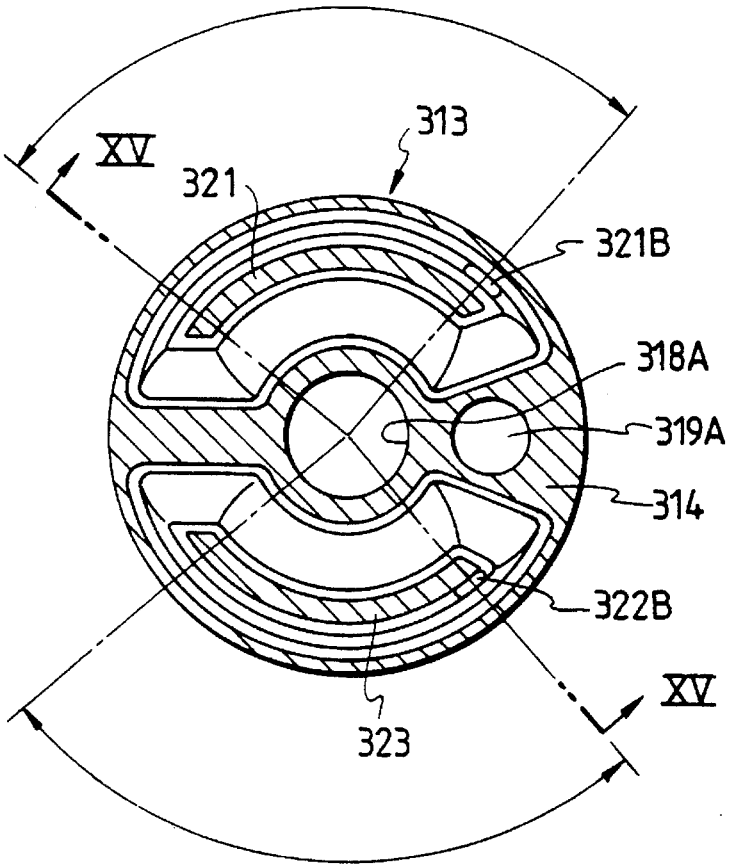
FIG. 14 is a plan view showing the partition tank depicted in FIG. 9A.
Figure 15:
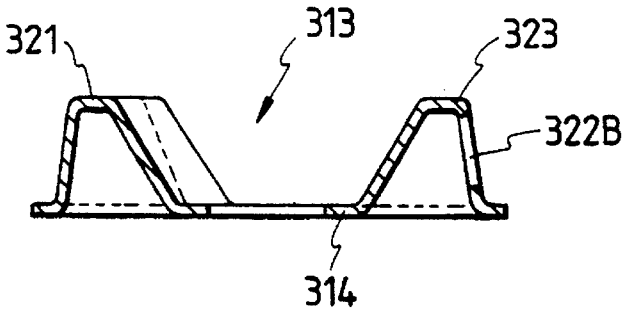
FIG. 15 is a sectional view showing the partition tank in the XV—XV section of FIG. 14.

Further, the degree of freedom with respect to mount positions of the cooling water inflow pipe 329 and the cooling water outflow pipe 330 to the composite tank 302 can be increased. That is, because the top portion of the first projection-like partition portion 321 of the partition tank 313 and the top portion of the second projection-like partition portion 323 of the partition tank 313 are shaped like a circular arc having a width in a plan view as shown in FIG. 14, the cooling water inflow pipe 329 and the cooling water outflow pipe 330 can be attached without departing from the ranges of the outer surfaces thereof, so that the angle of the mount range can be widened. As a result, the degree of freedom in layout at the time of mounting of the housingless type oil cooler to the engine side can be increased.

Further, in the third embodiment, the cooling water inflow pipe 329 and the cooling water outflow pipe 330 are fixed by the upper tank 311 and the partition tank 313. Accordingly, the strength in mounting of the cooling water inflow pipe 329 and the cooling water outflow pipe 330 can be improved. As a result, stress acting on the upper tank 311 and the partition tank 313 at the time of attaching hoses to the cooling water inflow pipe 329 and the cooling water outflow pipe 330 can be reduced extremely.

(2) Because the partition tank 313 is formed of an aluminum clad material having a sacrifice corrosive layer 313A formed in the inner circumferential side and a brazing material layer 313C formed in the outer circumferential side and because the upper tank 311 is formed of an aluminum clad material having a brazing material layer 311C formed in the inner circumferential side, the inner circumferential side of the first and second projection-like partition portions 321 and 323 in the inlet and outlet tank chambers 320 and 322 filled with cooling water is made to be a sacrifice corrosive layer 313A while joining of the upper tank 311 and the partition tank 313 by brazing is secured. Accordingly, progress of corrosion caused by cooling water with which the inlet and outlet tank chambers 320 and 322 are filled can be reduced, so that the corrosion-resisting properties of the first and second projection-like partition portions 321 and 323 in the inlet and outlet tank chambers 320 and 322 can be improved.

(3) Because the seat connector 325 has an annular flange 327 being in contact with the opening portion 319 of the inner cylindrical portion 316 of the upper tank 311, the seat connector 325 presses the opening portion 319 of the inner cylindrical portion 316 of the upper tank 311 toward the partition tank 313 through the annular flange 317 so that temporary fixing of the seat connector 325 and the upper tank 311 at the time of assembling of the composite tank 302 and the core portion 1 can be performed so that brazing can be performed securely.

(4) Because the respective top portions of the first and second projection-like partition portions 321 and 323 of the partition tank 313 being in contact with the inner wall surface of the annular top portion 315 of the upper tank 311 are formed so as to be flat and are fixed to a part of the inner wall surface of the annular top portion 315 by brazing, the thus flatly formed top portions of the first and second projection-like partition portions 321 and 323 of the partition tank 313 are joined with a part of the inner wall surface of the annular top portion 315 of the upper tank 311 by brazing so that not only the range of surface contact between the upper tank 311 and the partition tank 313 for brazing is reduced to the irreducible minimum but the range of brazing is provided as a surface. Accordingly, quality of brazing can be secured compared with butt joining, so that oil in the annular space 324 can be partitioned by the brazed portion securely.

As a result, the upper tank 311 and the partition tank 313 are separated securely so that occurrence of poor brazing can be prevented and the risk of occurrence of mixing of oil and cooling water can be eliminated.

(5) Because the outer circumferential surface of the outer cylindrical portion 317 of the upper tank 311 is joined/fixed to the outer surfaces of the first and second projection-like partition portions 321 and 323 of the partition tank 313 by brazing, the upper tank 311 and the partition tank 313 can be separated securely so that occurrence of poor brazing can be prevented and the risk of occurrence of mixing of oil and cooling water can be eliminated.

This reason is that the upper tank 311 and the partition tank 313 are processed by press forming in advance so that the partition tank 313 is put in the inside of the upper tank 311 so as to be fitted thereto at the time of assembling. Accordingly, even in the case where spring-back or sagging occurs in the upper tank 311 and the partition tank 313, the joint surface gap between the inner wall surface of the upper tank 311 and the outer surfaces of the first and second projection-like partition portions 321 and 323 of the partition tank 313 is kept uniform so that the gap size for brazing is secured.

(6) In the condition in which the partition tank 313 is put in the inside of the upper tank 311, they are mounted on the core portion 1. The seat connector 325 having an opening hole 326 formed is inserted in the opening portion 319 of the upper tank 311 of the composite tank 302 to widen the oil outflow pipe 47 radially to thereby mechanically tighten the core portion 1 and the composite tank 302. Thus, not only the core portion 1 per se but the core portion 1 and the composite tank 302 are fixed temporarily. In this occasion, radial force acts on the engagement portion between the seat connector 325 and the oil outflow pipe 47 because of the widening of the oil outflow pipe 47. In this manner, the core portion 1 per se and the core portion 1 and the composite tank 302 can be brazed in a furnace without any jig member. That is, the core portion 1 per se and the core portion 1 and the composite tank 302 can be assembled temporarily by a method not using any jig member.

Figure 16:
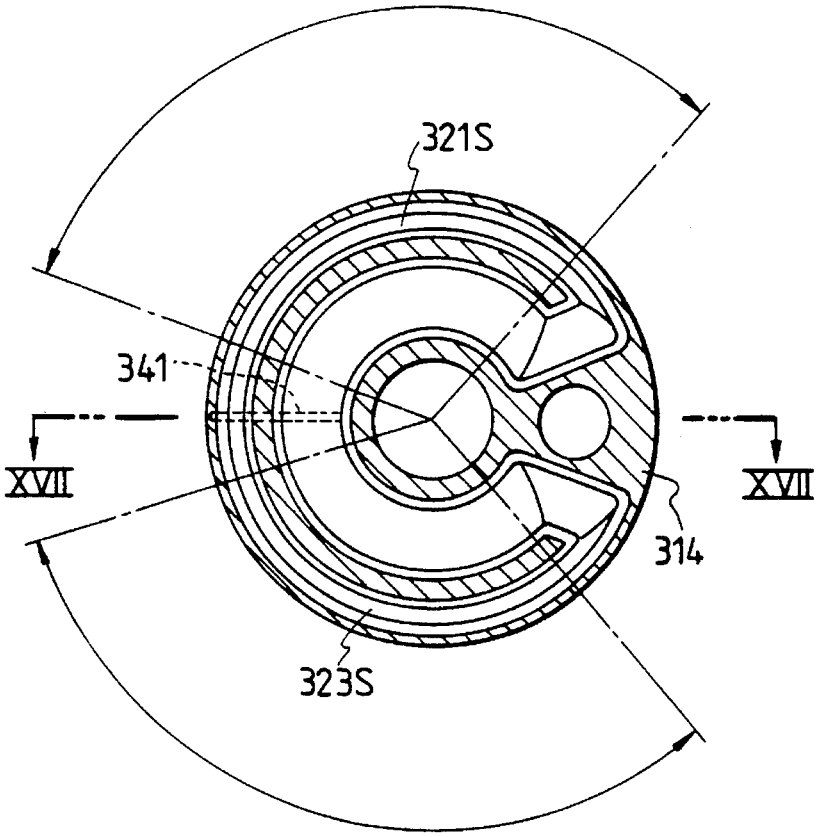
FIG. 16 is a plan view showing a modified example of the partition tank.
Figure 17:
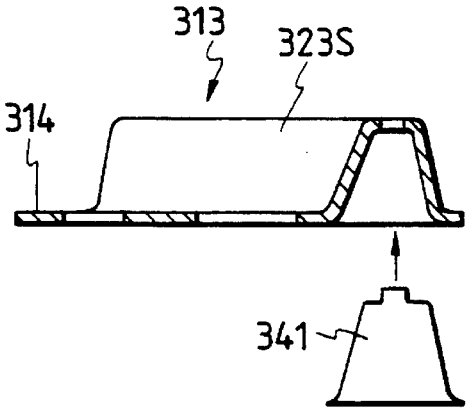
FIG. 17 is a sectional view showing the partition tank in the XVII—XVII section of FIG. 16.
Figure 18:
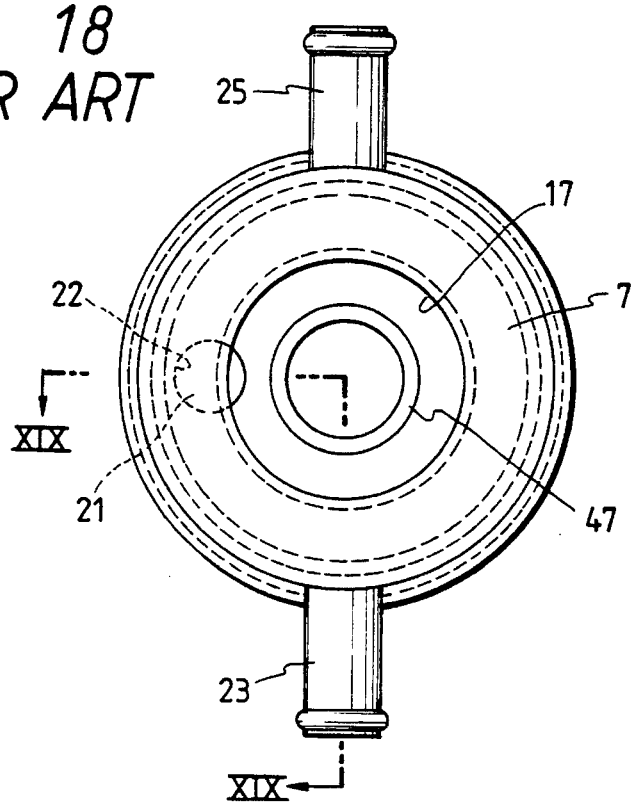
FIG. 18 PRIOR ART
FIG. 18 is a plan View of a conventional housingless type oil cooler.
Figure 19:
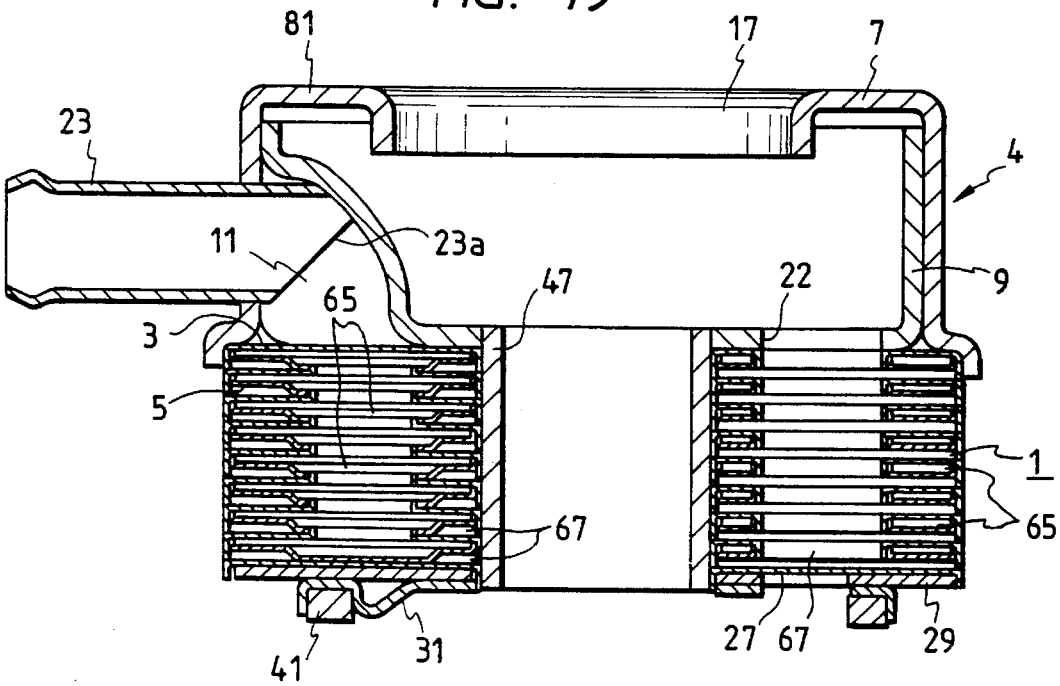
FIG. 19 PRIOR ART
FIG. 19 is a sectional view taken along the XIX—XIX line of FIG. 18.
Figure 20:
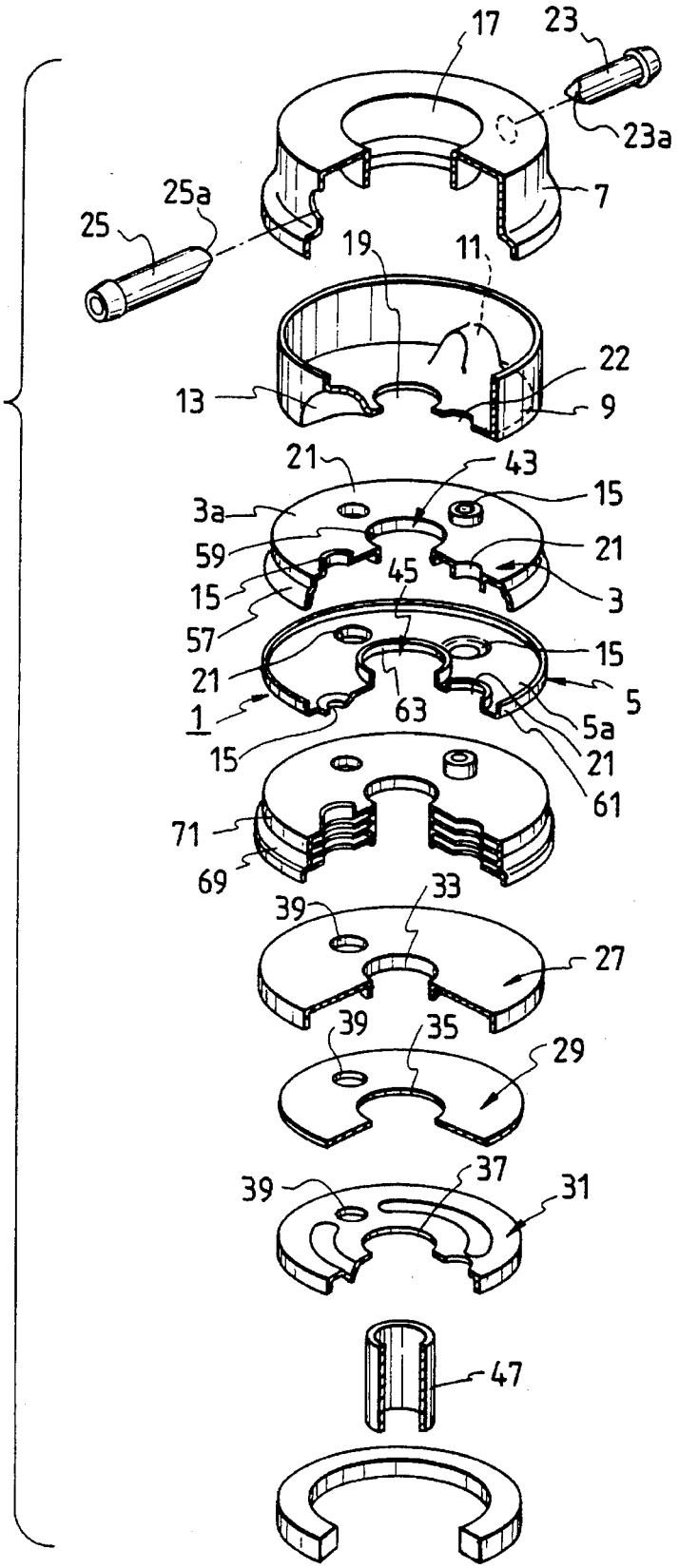
FIG. 20 PRIOR ART
FIG. 20 is an exploded perspective view of the housingless type oil cooler depicted in FIG. 18.

Although the third embodiment has shown the case where the first and second projection-like partition portions 321 and 323 on the flat portion 314 are disposed so as to be far from each other, first and second projection-like partition portions 321S and 323S can be formed so as to be integrated with each other through a partition plate 341 as shown in FIGS. 16 and 17. In this case, ranges of respective top portions and respective outer surfaces of the first and second projection-like portions 321S and 323S of the partition tank 313 to which the cooling water inflow pipe 329 and the cooling water outflow pipe 330 are attached are widened so that the degree of freedom in mount positions of the cooling water inflow pipe 321S and the cooling water outflow pipe 323S to the composite tank 302 can be increased. In FIG. 16, the oblique line portion shows the flat portion 314.

Although the third embodiment has shown the case where the upper plate 303 in which the through-hole 303A, the oil outflow port 305, the cooling water inflow port 307 and the cooling water outflow port 309 are formed is disposed in the upper portion of the core portion it the present invention can be applied to the case where the upper plate 303 having such structure is not provided as long as the plate thickness of the partition tank 313, or the like, can be selected suitably.

As described above, according to the housingless type oil cooler of the third aspect of the present invention, the opening portion of the inner cylindrical portion of the upper tank is connected to the seat connector which is dynamically connected to the oil outflow pipe. Accordingly, force acting on the upper tank of the composite tank at the time of tightening of the oil filter is transmitted to the oil outflow pipe through the seat connector so that force acting on the upper surface of the core portion from the upper tank can be reduced.

Because the upper tank mounted on the upper portion of the core portion has an annular top portion through which the upper tank is supported to the first and second projection-like partition portions of the partition tank and because the opening portion of the inner cylindrical portion of the upper tank is supported to the flat portion of the partition tank through the seat connector, the upper tank, the partition tank and the seat connector are provided as a strong mount portion for the oil filter.

Accordingly, even in the case where the oil filter is tightened strongly, the upper tank constituting an oil filter sealing surface is never deformed so that occurrence of oil leaking can be prevented.

Further, because the upper tank and the partition tank are processed by press forming in advance so that the partition tank is put in the inside of the upper tank so as to be fitted thereto at the time of assembling, the height of the composite tank can be reduced even in the case where spring-back or sagging occurs. Further, because the partition tank is put in the inside of the upper tank so as to be fitted thereto, the cooling water outflow pipe and the cooling water inflow pipe can be attached to the composite tank while the outer surfaces of the upper tank and the first and second projection-like partition portions of the partition tank are inclined. As a result, the height size of the composite tank can be reduced, so that the size of the housingless oil cooler can be reduced.

According to the housingless type oil cooler of the third aspect of the present invention, because the partition tank may be formed of an aluminum clad material having a sacrifice corrosive layer formed in the inner circumferential side and a brazing material layer formed in the outer circumferential side and because the upper tank is formed of an aluminum clad material having a brazing material layer formed in the inner circumferential side, the inner circumferential side of the first and second projection-like partition portions in the inlet and outlet tank chambers filled with cooling water is made to be a sacrifice corrosive layer while joining of the upper tank and the partition tank by brazing is secured. Accordingly, progress of corrosion caused by cooling water with which the inlet and outlet tank chambers are filled can be reduced, so that the corrosion-resisting properties of the first and second projection-like partition portions in the inlet and outlet tank chambers can be improved.

According to the housingless type oil cooler of the third aspect of the present invention, because the seat connector may have an annular flange being in contact with the opening portion of the inner cylindrical portion of the upper tank, the seat connector presses the opening portion of the inner cylindrical portion of the upper tank toward the partition tank through the annular flange so that temporary fixing of the seat connector and the upper tank at the time of assembling of the composite tank and the core portion can be performed so that brazing can be performed securely.

According to the housingless type oil cooler of the third aspect of the present invention, because the respective top portions of the first and second projection-like partition portions of the partition tank being in contact with the inner wall surface of the annular top portion of the upper tank may be formed so as to be flat and may be fixed to a part of the inner wall surface of the annular top portion by brazing, the thus flatly formed top portions of the first and second projection-like partition portions of the partition tank are joined with a part of the inner wall surface of the annular top portion of the upper tank by brazing so that not only the range of surface contact between the upper tank and the partition tank for brazing is reduced to the irreducible minimum but the range of brazing is provided as a surface. Accordingly, the quality of brazing can be secured compared with butt joining, so that oil in the annular space can be partitioned by the brazed portion securely.

As a result, the upper tank and the partition tank are separated securely so that occurrence of poor brazing can be prevented and the risk of occurrence of mixing of oil and cooling water can be eliminated.

According to the housingless type oil cooler of the third aspect of the present invention, in the condition in which the partition tank Is put in the inside of the upper tank, the assembly of those tanks is mounted on the core portion. The seat connector having an opening hole formed is inserted in the opening portion of the upper tank of the composite tank to widen the oil outflow pipe and the seat connector radially to thereby mechanically tighten the core portion and the composite tank. Thus, not only the core portion per se but the core portion and the composite tank can be fixed temporarily, so that the core portion per se and the core portion and the composite tank can be brazed in a furnace without any jig member. That is, the core portion per se and the core portion and the composite tank can be assembled temporarily by a method not using any jig member.

While the present invention has been described above merely with respect to a single preferred embodiment thereof, it should of course be understood that the present invention should not be limited only to this embodiment but various change or modification may be made without departure from the scope of the present invention as defined by the appended claims. For example, the present invention may equally be applied to a single row spherical roller bearing without any modification from the construction as mentioned above.

What is claimed is:

1. A housingless type oil cooler comprising:

a core portion (1) constituted by a plurality of plates (3, 5) respectively having through-holes (43, 45) formed at their center portions, said plates (3, 5) being alternately laminated on one another so that cooling water passages (65) and oil passages (67) are alternately formed between said plates (3, 5); and one of an oil filter (77) and a sealed flange (401) mounted on said core portion (1); wherein:

an upper tank (111) opened at its one side, donut-shaped and having a first communicating hole (111A) in its inner wall, is mounted on an upper portion of said core portion (1);

a partition plate (113) is disposed inside of said upper tank (111);

a through-hole (119), an inlet hole (121) and an outlet hole (123) are formed in a flat portion of said partition plate (113) so that said inlet hole (121) and said outlet hole (123) overlap an inlet (65A) and an outlet (65B) of said cooling water passages (65) respectively, and an oil-passing projection portion (115) and a projection-like partition portion (117) are formed on said flat portion of said partition plate (113) so that said oil-passing projection portion (115) has its inside communicated with an outlet (67B) of said oil passages (67) and has a second communicating hole (115A) formed in its inner wall so as to overlap said first communicating hole (111A) of said upper tank (111) and so that said projection-like partition portion (117) is attached at its surface onto an inner wall surface of a top portion (111C) of said upper tank (111) to thereby partition the inside of said upper tank (111) into an inlet tank chamber (125) and an outlet tank chamber (127); and a cooling water inflow pipe (131) and a cooling water outflow pipe (133) are connected to said upper tank (111) so as to be communicated with said inlet and outlet tank chambers (125 and 127) of the upper tank (111) respectively.

2. A housingless type oil cooler according to claim 1, in which:

said one of said oil filter (77) and said sealed flange (401) is mounted on said top portion (111C) of said upper tank (111) so as to be communicated with the inside of said oil-passing projection portion (115) of said partition plate (113) through said first communicating hole (111A) of said upper tank (111) and said second communicating hole (115A) of said partition plate (113); and an oil return pipe (129) having at least one opening portion communicated with one of said oil filter (77) and the inside chamber of said sealed flange (401) is disposed so as to pass through said through-hole (119) of the upper tank (111) and said partition plate (113) and said through-holes (43, 45) of said core portion (1).

* * * * *